US006961288B2

(12) United States Patent
Iijima

(10) Patent No.: US 6,961,288 B2
(45) Date of Patent: Nov. 1, 2005

(54) SOUND-SCALE GENERATION DEVICE AND TIME-ANNOUNCING CLOCK

(75) Inventor: Takashi Iijima, 13-63, Ikkimachi Matsunaga 3-chome, Aizuwakamatsu-shi, Fukushima 965-0001 (JP)

(73) Assignees: Takashi Iijima, Fukushima (JP); Rhythm Watch Co., Ltd., Tokyo (JP)

( * ) Notice: Subject to any disclaimer, the term of this patent is extended or adjusted under 35 U.S.C. 154(b) by 174 days.

(21) Appl. No.: 10/690,721

(22) Filed: Oct. 23, 2003

(65) Prior Publication Data

US 2004/0144240 A1 Jul. 29, 2004

(30) Foreign Application Priority Data

Oct. 25, 2002 (JP) ..... 2002-311088

(51) Int. Cl.[7] ..... G04B 19/00; G04B 21/00; G04B 25/00

(52) U.S. Cl. ..... 368/272; 368/273; 368/245

(58) Field of Search ..... 368/75, 272, 273, 368/243, 245, 244; 84/698

(56) References Cited

U.S. PATENT DOCUMENTS 2,401,199 A * 5/1946 Talbot ..... 368/273
4,457,631 A * 7/1984 Takebe ..... 368/273
4,487,099 A * 12/1984 Ebihara ..... 84/702
4,575,832 A * 3/1986 Takebe ..... 368/272
4,699,518 A * 10/1987 Tanabe ..... 368/75
6,898,153 B1 * 5/2005 Della Rossa ..... 368/75

FOREIGN PATENT DOCUMENTS

JP 3-11275 U 2/1991

OTHER PUBLICATIONS

Tamura N, Outline of Music, Ongakunotomosha, May 31, 1956 pp. 122 to 123.

* cited by examiner

*Primary Examiner*—Andrew H. Hirshfeld
*Assistant Examiner*—Leo T. Hinze
(74) *Attorney, Agent, or Firm*—Birch Stewart Kolasch & Birch LLP

(57) ABSTRACT

A sound-scale generation device and time-announcing clock eliminating the unpleasantness when a sound of a dissonant interval or imperfect consonant interval is generated, provided with a clock circuit generating a sound generation instruction signal at a fixed time, a frequency divider serving as a sound generator able to generate at least a 12-sounds scale, an amplifier, a speaker, a sequential switching circuit linking the 12-sounds of the 12-sounds scale and times corresponding to the fixed time and controlling the sound generator so as to generate a basic sound of one sound of the 12-sounds scale, then generate scale-forming-sounds corresponding to a time every time receiving a sound generation instruction signal, and a harmonic-sound adder controlling the sound generator so as to generate a sound by superposing at least one of the harmonic-sound forming sounds able to form a harmonic-sound including the scale-forming-sound when the sequential switching circuit makes the sound generator generate at least a scale-forming-sound of a dissonant interval and/or imperfect consonant interval with respect to the basic sound.

7 Claims, 15 Drawing Sheets

FIG. 2

| Consonant or dissonant interval | | (Pitch ratio) | |
|---|---|---|---|
| Consonant interval | Perfect | Perfect 1st | 1:1 |
| | | Perfect 8th | 1:2 |
| | | Perfect 5th | 2:3 |
| | | Perfect 4th | 3:4 |
| | Imperfect | Major 3rd | 4:5 |
| | | Minor 3rd | 5:6 |
| | | Major 6th | 3:5 |
| | | Minor 6th | 5:8 |
| Dissonant interval | | Major 2nd | 8:9 |
| | | Minor 2nd | 15:16 |
| | | Major 7th | 8:15 |
| | | Minor 7th | 9:16 |
| | | Augmented 4th | 5:7 |

FIG. 3

| Time | Interval | Keyboard | |
|---|---|---|---|
| 0 o'clock | Perfect 1st c1 | White | Perfect consonant interval |
| 1 o'clock | Augmented 1st c1# | Black | Dissonant interval |
| 2 o'clock | Major 2nd d1 | White | Dissonant interval |
| 3 o'clock | Augmented 2nd d1# | Black | Imperfect consonant interval |
| 4 o'clock | Major 3rd e1 | White | Imperfect consonant interval |
| 5 o'clock | Perfect 4th f1 | White | Perfect consonant interval |
| 6 o'clock | Augmented 4th f1# | Black | Dissonant interval |
| 7 o'clock | Perfect 5th g1 | White | Perfect consonant interval |
| 8 o'clock | Augmented 5th g1# | Black | Imperfect consonant interval |
| 9 o'clock | Major 6th a1 | White | Imperfect consonant interval |
| 10 o'clock | Augmented 6th a1# | Black | Dissonant interval |
| 11 o'clock | Major 7th b1 | White | Dissonant interval |
| 12 o'clock | Perfect 8th c2 | White | Perfect consonant interval |

SOUND-SCALE GENERATION DEVICE AND TIME-ANNOUNCING CLOCK

This Nonprovisional application claims priority under 35 U.S.C. § 119(a) on Patent Application No(s). 2002-311088 filed in Japan on Oct. 25, 2002, the entire contents of which are hereby incorporated by reference.

BACKGROUND OF THE INVENTION

1. Field of the Invention

The present invention relates to a sound-scale generation device announcing a fixed time and a time-announcing clock.

2. Description of the Related Art

There has been known a 12-sounds scale generation device optimal for acoustic training (for example, see Japanese Unexamined Utility Model Publication (Kokai) No. 3-11275). Such the 12-sounds scale generation device generates a basic sound of one sound of the 12-sounds scale at a fixed time, then generates a predetermined scale-forming-sound corresponding to that time. A user can listen to the basic sound and the scale-forming-sound and recognize the time based on the basic sound, scale-forming-sound, sound-interval, and predetermined correspondence between sound-intervals and times.

Here, the difference in pitch between two sounds is called as a "sound-interval". When a ratio of vibration numbers (frequencies) of two sounds physically is 1:2, the two sounds are said to be in the relationship of an octave. The above 12-sounds scale generation device generates two sounds by a melodic interval where the two successively reverberate. On the other hand, a sound-interval where two sounds simultaneously reverberate is called as a "harmonic interval".

The sound-intervals of two sounds in an octave may be roughly classified into consonant intervals and dissonant intervals. A consonant interval is an interval giving a pleasant feeling by the fused state of two sounds when two sounds reverberate like a harmonic-sound, while a dissonant interval gives an unpleasant feeling (for example, see Tamura N., Outline of Music, Ongakunotomosha, May 31, 1956, pp. 122 to 123).

In more detail, intervals between a basic sound and time-announcing sounds which are scale-forming-sounds corresponding to the respective times, are categorized into perfect consonant intervals, imperfect consonant intervals, and dissonant intervals. In the above 12-sounds scale generation device, when generating a dissonant interval and imperfect consonant interval at predetermined times, the user sometimes finds the sound heard to be unpleasant. This unpleasant sound is generated repeatedly when the predetermined time arrives, so a sound-scale generation device or time-announcing clock eliminating this unpleasantness is desired.

SUMMARY OF THE INVENTION

An object of the present invention is to provide a sound-scale generation device and time-announcing clock, eliminating the unpleasantness when a dissonant interval or imperfect consonant interval is generated.

According to a first aspect of the present invention, there is provided a sound-scale generation device comprising a clock means counting a time and generating a sound generation instruction signal at a fixed time, a sound generator able to generate a sound of a 12-sounds scale, a sound generating controller linking a sound of each sound-scale the 12-sounds scale and a time corresponding to the fixed time and controlling the sound generator so as to generate a basic sound defined as one sound of the 12-sounds scale, and generate a first scale-forming-sound corresponding to the time at which receiving the sound generation instruction signal, and a harmonic-sound forming sound adder controlling the sound generator so as to generate a sound by superposing at least one of the harmonic-sound forming sounds able to form a harmonic-sound including the first scale-forming-sound when the sound generating controller makes the sound generator generate a second scale-forming-sound of a dissonant interval and/or imperfect consonant interval with respect to the basic sound.

Preferably, harmonic-sound forming sound adder controls the sound generator so as to generate a sound by superposing at least one of the harmonic-sound forming sounds able to form a harmonic-sound including the first scale-forming-sound when the sound generating controller makes the sound generator generate a third scale-forming-sound corresponding to a black key interval with respect to the basic sound.

Preferably, the harmonic-sound forming sound adder controls the sound generator so as to generate a sound by superposing at least one of the harmonic-sound forming sounds able to form the harmonic-sound including the basic sound when the sound generating controller makes the sound generator generate the basic sound.

Preferably, the sound generating controller controls the sound generator so as to generate an announcement sound for announcing the basic sound before making the sound generator generate the basic sound.

Preferably, the sound-scale generation device further comprises a center position light emitting means provided at a substantially center position of a faceplate displaying the scale-forming-sound corresponding to the fixed times and emitting light at the fixed time and time light emitting means provided at positions corresponding to the scale-forming-sounds corresponding to the fixed times so as to surround the center position light emitting means and emitting light corresponding to the scale-forming-sounds.

Preferably, the sound generating controller controls the sound generator so that the type of generation of the first scale-forming-sounds differ between even times and odd times among times linked with the sounds of the 12-sounds scale.

Preferably, the sound generating controller controls the sound generator so as to generate the basic sound, then generate a fourth scale-forming-sound corresponding to that time by a tempo different between even times and odd times among times linked with the sounds of the 12-sounds scale.

According to a second aspect of the present invention, there is provided a time-announcing clock announcing a fixed time comprising a clock means counting a time and generating a sound generation instruction signal at a fixed time, a sound generator able to generate a sound of a 12-sounds scale, a sound generating controller linking a sound of the 12-sounds scale and a time corresponding to the fixed time and controlling the sound generator so as to generate a basic sound defined as one sound of the 12-sounds scale, then generate a first scale-forming-sound corresponding to the time at which receiving the sound generation instruction signal, and a harmonic-sound forming sound adder controlling the sound generator so as to generate a sound by superposing at least one of the harmonic-sound forming sounds able to form a harmonic-sound including the first scale-forming-sound when the sound generating controller makes the sound generator generate a second scale-forming-sound of a dissonant interval and/or imperfect consonant interval with respect to the basic sound.

BRIEF DESCRIPTION OF THE DRAWINGS

These and other objects and features of the present invention will become clearer from the following description of the preferred embodiments given with reference to the attached drawings, wherein:

FIG. 2 is a view for explaining intervals of sounds of a 12-sounds scale;

FIG. 3 is a view of types of intervals of a 12-sounds scale linked with predetermined fixed times generated by the sound-scale generation device shown in FIG. 1;

DESCRIPTION OF THE PREFERRED EMBODIMENTS

Preferred embodiments of the present invention will be described in detail below with reference to the attached drawings.

First Embodiment

Figure 1:
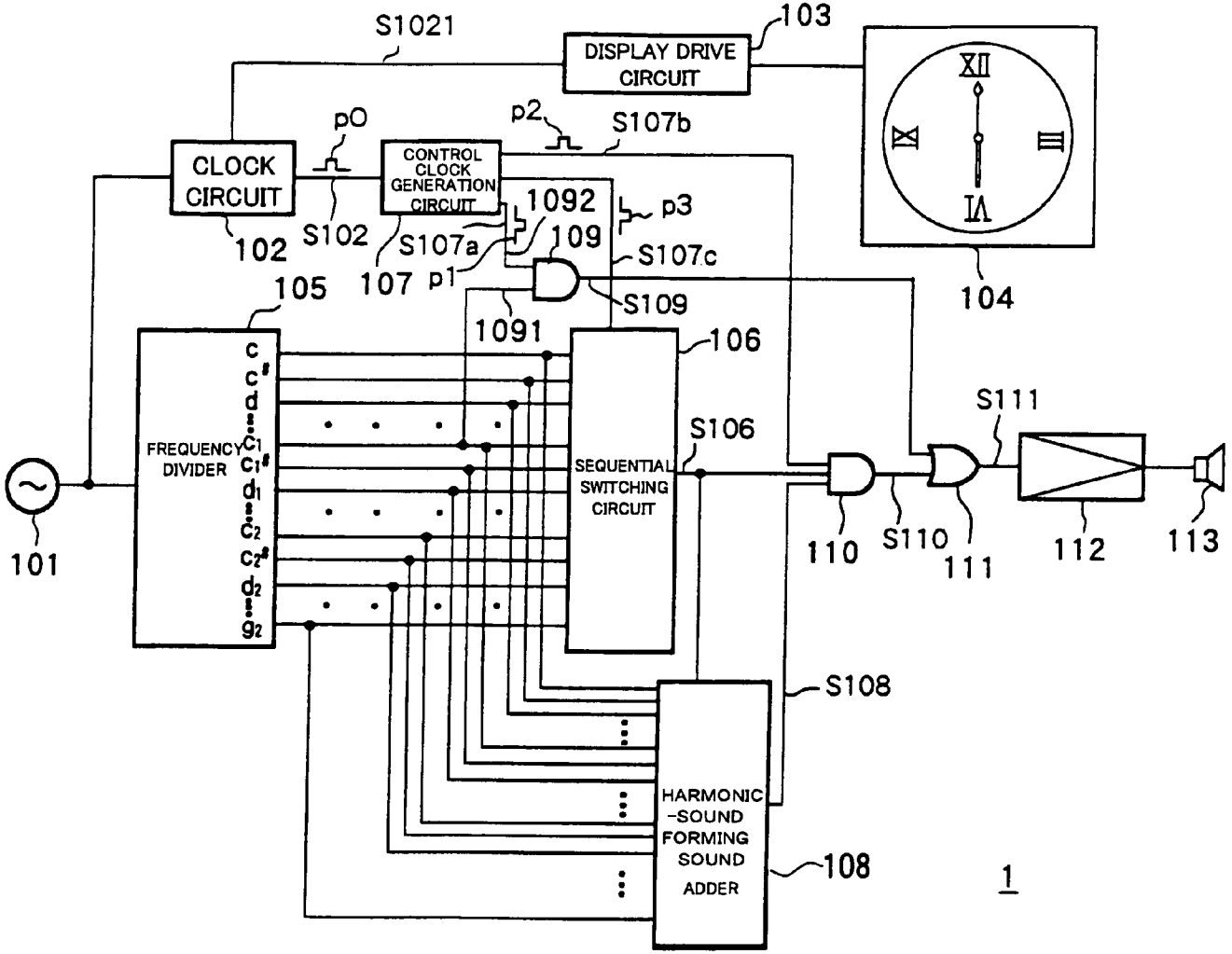
FIG. 1 is a functional block diagram of a first embodiment of a sound-scale generation device according to the present invention.

FIG. 1 is a functional block diagram of a first embodiment of a sound-scale generation device according to the present invention. The sound-scale generation device 1 according to the first embodiment is used as a time-announcing clock for generating sounds of a 12-sounds scale at fixed times.

The sound-scale generation device 1 has a reference clock generator 101, a clock circuit 102, a display drive circuit 103, a time display panel 104, a frequency divider 105, a sequential switching circuit 106, a control clock generating circuit 107, a harmonic-sound forming sound adder 108, a basic sound gate (AND gate) 109, a time announcement sound gate (AND gate) 110, an OR gate 111, an amplifier 112, and a speaker 113.

The clock circuit 102 corresponds to a clock means according to the present invention; the frequency divider 105, amplifier 112, and speaker 113 correspond to a sound generator according to the present invention; the sequential switching circuit 106 corresponds to a sound generating controller according to the present invention; and the harmonic-sound forming sound adder 108 corresponds to a harmonic-sound forming sound adder of the present invention.

The reference clock generator 101 is for example configured by a high precision quartz oscillator, generates a reference clock of a constant frequency at a high frequency serving as the basis of the count of the time, and outputs the same to the clock circuit 102 and the frequency divider 105.

The clock circuit 102 measures the time by counting the reference clock signal from the reference clock generator 101, generates a single minute hand drive pulse of the clock every minute, and outputs a signal s1021 to the display drive circuit 103. Further, the clock circuit 102 generates an "hour" digit changing (switching) signal s102 for indicating a change of the "hour" at every hour (a fixed time) and outputs it to the display drive circuit 103. The "hour" digit changing signal corresponds to the sound generating instruction signal according to the present invention.

For example, in more detail, the clock circuit 102 generates an "hour" digit changing signal at every "hour" switching time, that is, on every hour of 0 o'clock am, 1 o'clock am, 2 o'clock am, . . . , 11 o'clock am, noon, 1 o'clock pm, . . . , and 11 o'clock pm, and outputs it to the display drive circuit 103.

The display drive circuit 103 amplifies the hand drive pulse from the clock circuit 102, outputs it to the time display panel 104 to operate a hand drive mechanism built in the time display panel 104, and advances a minute hand and a hour hand of the clock by exactly angles corresponding to one minute.

The frequency divider 105 divides the reference clock signal output from the reference clock generator to frequencies corresponding to the sounds of the following 12-sounds equal temperament scale having a reference frequency comprised of a scale-forming-sound a1 (for example, 440 Hz; like musical performance) and thereby generates clock signals of those frequencies (hereinafter, sound signals c, c♯, d, . . . , c1, c1♯, d1, . . . , c2, c2♯, d2, . . . , g2, . . . etc.). Note that the unit is Hz.

More specifically, for example, c=130.81, c♯=138.59, d=146.83, d♯=155.56, e=164.81, f=174.61, f♯=185.00, g=196.00, g♯207.65, a=220.00, a♯=233.08, b=246.94, c1=261.63, c1♯277.18, d1=293.66, d1♯=311.13, e1=329.63, f1=349.23, f1♯=369.99, g1=392.00, g1♯415.30, a1=440.00, a1♯=466.16, b1=493.88, c2=523.25, c2♯=554.37, d2=587.33, d2♯=622.25, e2=659.26, f2=698.46, f2♯=739.99, g2=783.99, . . . etc.

The sequential switching circuit 106 receives the output signals of the frequency divider 105 as the switching data and outputs one of these selectively to the time announcement sound gate (AND gate) 110 and harmonic-sound forming sound adder 108 as a signal s106. Specifically, for example, the sequential switching circuit 106 switches the output signal in response to a switching timing pulse p3 output from the later-mentioned control clock generating circuit 107.

The control clock generating circuit 107 generates a basic sound gate pulse p1 in response to the "hour" digit changing signal output from the clock circuit 102, outputs this to the basic sound gate (AND gate) 109 as an output signal s107*a*, then generates a time-linked sound (also called "time announcement sound") after the elapse of the sustained time of the basic sound gate pulse p1, outputs this to the time announcement sound gate (AND gate) 110 as an output signal s107*b*, then finally generates the switching timing pulse p3 after the elapse of the sustained time of the time announcement sound gate pulse p2 and outputs this to the sequential switching circuit 106 as the output signal s107*c*.

The basic sound gate pulse p1 and the time-linked sound (time announcement sound) gate pulse p2 are sustained for times of about 1 second each. A 1 second silent time is provided from when the basic sound gate pulse p1 falls to when the time-linked sound (time announcement sound) gate pulse p2 rises.

The switching timing pulse p3 is supplied to the sequential switching circuit 106 as the input switching clock. The sequential switching circuit 106 sequentially switches what is generated from the input data from the frequency divider 105 at the output terminal in the order of c1 to c2 each time receiving the switching timing pulse p3 of the output signal s107*c*. Due to the initialization of the time of generation of the "hour" switching (changing) pulse p0 of the clock circuit 102 and the output data of the sequential switching circuit 106 and the initialization of the time of generation of the "hour" switching pulse p0 and the output data of the sequential switching circuit 106, the correspondence between the switching times of the "hour" and the scale-forming-sounds c1 to c2 of the at least 12-sounds scale is determined.

The harmonic-sound forming sound adder 108 controls the sound generator, which is comprised of the frequency divider 105, amplifier 112 and speaker 113, so as to generate a sound by superposing at least one of the harmonic-sound forming sounds able to form a harmonic-sound including a scale-forming-sound of a dissonant interval and imperfect consonant interval when the sequential switching circuit 106 makes the sound generator generate a scale-forming-sound of the dissonant interval and/or imperfect consonant interval with respect to the basic sound "bs" based on the output signal s106 from the sequential switching circuit 106.

More specifically, the harmonic-sound forming sound adder 108 controls the sound generator to generate a sound by superposing at least one of the harmonic-sound forming sounds able to form a harmonic-sound including a scale-forming-sound of a dissonant interval and imperfect consonant interval when the output signal s106 is a scale-forming-sound of a dissonant interval and/or imperfect consonant interval based on the output signal s106 from the sequential switching circuit 106.

FIG. 2 is a view for explaining the sound-intervals of the sounds of a 12-sounds scale. The intervals of two sounds in an octave of a 12-sounds scale, as shown in FIG. 2, are classified into consonant intervals and dissonant intervals. A consonant interval is an consonant interval giving a pleasant feeling due to the fused state of two sounds when two sounds reverberate like a harmonic-sound. A consonant interval has a simple pitch ratio of the two sounds physically speaking.

Consonant intervals include perfect consonant intervals and imperfect consonant intervals. In a perfect consonant interval, when two sounds are simultaneously generated, they reverberate while perfectly fusing. A perfect consonant interval has an extremely simple pitch ratio of the two sounds. A perfect consonant interval includes a perfect 1st where the pitch ratio is 1:1, a perfect 8th where the pitch ratio is 1:2, a perfect 5th where the pitch ratio is 2:3, and a perfect 4th where the pitch ratio is 3:4.

In an imperfect consonant interval, two sounds reverberate somewhat fused but not perfectly compared with a perfect consonant interval when simultaneously generated. An imperfect consonant interval is more complicated than a perfect consonant interval in pitch ratio of the two sounds. An imperfect consonant interval includes a major 3rd where the pitch ratio is 4:5, a minor 3rd where the pitch ratio is 5:6, a major 6th where the pitch ratio is 3:5, and a minor 6th where the pitch ratio is 5:8.

A dissonant interval is an interval where two sounds do not fuse together when simultaneously generated and give an unpleasant feeling. A dissonant interval is an interval other than the above perfect consonant interval and imperfect consonant interval. In a dissonant interval, the pitch ratio of the two sounds is complicated.

A dissonant interval includes a major 2nd where the pitch ratio is 8:9, a minor 2nd where the pitch ratio is 15:16, a major 7th where the pitch ratio is 8:15, a minor 7th where the pitch ratio is 9:16, and an augmented 4th where the pitch ratio is 5:7.

FIG. 3 is a view of the types of intervals of a 12-sounds scale linked with predetermined times where a sound is generated by the sound-scale generation device shown in FIG. 1. The harmonic-sound forming sound adder 108, as shown for example in FIG. 3, judges if the output data is a perfect consonant interval, imperfect consonant interval, or dissonant interval based on the output data output from the sequential switching circuit 106.

The sequential switching circuit 106 outputs as the time announcement sound "ts", for example, as shown in FIG. 3, output data of sound-intervals of c1 of the perfect 1st, c1♯ of the augmented 1st, d1 of the major 2nd, d1♯ of the augmented 2nd, e1 of the major 3rd, f1 of the perfect 4th, f1♯ of the augmented 4th, g1 of the perfect 5th, g1♯ of the augmented 5th, a1 of the major 6th, a1♯ of the augmented 6th, b1♯ of the major 7th, and c2 of the perfect 8th at the time 0 o'clock to 12 o'clock to the harmonic-sound forming sound adder 108. Here, the augmented 1st is the minor 2nd, the augmented 2nd is the minor 3rd, and the augmented 6th is the minor 7th.

The time announcement sounds "ts" corresponding to the times 0 o'clock to 12 o'clock, as shown in FIG. 3, correspond to a perfect consonant interval, dissonant interval, dissonant interval, imperfect consonant interval, imperfect consonant interval, perfect consonant interval, dissonant interval, perfect consonant interval, imperfect consonant interval, imperfect consonant interval, dissonant interval, dissonant interval, and perfect consonant interval.

Sounds of intervals of the perfect 1st, major 2nd, major 3rd, perfect 4th, perfect 5th, major 6th, major 7th, and perfect 8th correspond to sounds generated when for example playing the white keys of a keyboard of a piano (called "white key intervals"). Sound of intervals of the augmented 1st (minor 2nd, augmented 2nd (minor 3rd), augmented 4th, augmented 5th, and augmented 6th (minor 7th) correspond to sounds generated when for example playing the black keys of a keyboard of a piano (called "black key intervals").

The harmonic-sound forming sound adder 108 controls the sound generator so as to generate a sound by superposing at least one of the harmonic-sound forming sounds able to form a harmonic-sound including a scale-forming-sound of a dissonant interval and imperfect consonant interval, when the data output from the sequential switching circuit 106 is a dissonant interval and imperfect consonant interval and when an interval corresponds to a black key interval.

FIGS. 4A to 4E are views for explaining the generation of sounds by the sound-scale generation device shown in FIG. 1. FIGS. 4A and 4B are views for explaining basic sounds and time announcement sounds corresponding to predetermined times. FIGS. 4C and 4D are views for explaining time announcement sounds of dissonant intervals and imperfect consonant intervals obtained by adding harmonic-sound forming sounds to basic sounds generated from the sound generator of the sound-scale generation device shown in FIG. 1, corresponding to predetermined times.

For example, if the time announcement sound "ts" is at a dissonant interval or imperfect consonant interval from a basic sound "bs" when the basic sound "bs" and the time announcement sound "ts", as shown in FIGS. 4A and 4B, are generated from the speaker 113 of the sound generator as c1, c1 at 0 o'clock, generated as c1, c1♯ at 1 o'clock, generated as c1, d1 at 2 o'clock, generated as c1, d1♯ at 3 o'clock, generated as c1, e1 at 4 o'clock, generated as c1, f1 at 5 o'clock, generated as c1, f1♯ at 6 o'clock, generated as c1, g1 at 7 o'clock, generated as c1, g1♯ at 8 o'clock, generated as c1, a1 at 9 o'clock, generated as c1, a1♯ at 10 o'clock, generated as c1, b1 at 11 o'clock, and generated as c1, c2 at 12 o'clock, the user is given an unpleasant feeling. Note that the basic sound "bs" and time announcement sound "ts" are shown punctuated by ",". Further, the length of generation of the sounds is a half sound.

Therefore, a major 3 harmonic-sound including the time announcement sound "ts" obtained by superposing at least one major 3 harmonic-sound forming sound including the time announcement sound "ts" is generated from the speaker 113 so that the time announcement sound "ts" which a user particularly finds (feels) unpleasant (black key interval of 1 o'clock, 3 o'clock, 6 o'clock, 8 o'clock, and 10 o'clock) becomes the cheerfully sounding major 3 harmonic-sound.

More specifically, as shown in FIGS. 4C and 4D, at the times 0 o'clock to 12 o'clock, when output data of sound-intervals of cl of the perfect 1st, c1♯ of the augmented 1st, d1 of the major 2nd, d1♯ of the augmented 2nd, e1 of the major 3rd, f1 of the perfect 4th, f1♯ of the augmented 4th, g1 of the perfect 5th, g1♯ of the augmented 5th, a1 of the major 6th, a1♯ of the augmented 6th, b1♯ of the major 7th, and c2 of the perfect 8th are output from the sequential switching circuit 106 as the time announcement sounds "ts" to the harmonic-sound forming sound adder 108, the harmonic-sound forming sound adder 108 outputs the harmonic-sound forming sounds of output off (also simply called "off", f♯+a♯, off, $a^b$+c1, off, off $c1^b$+$e1^b$, off, $d1^b$+f1, off, $e1^b$+g1, off, and off to the time announcement sound gate AND gate 110 as an output signal s108.

Here, when the harmonic-sound forming sound adder 108 does not output a harmonic-sound forming sound to the time announcement sound gate (AND gate) 110 when output data of a perfect consonant interval is output from the sequential switching circuit 106. Further, the symbol "+" indicates simultaneous generation. Further, at the time of generation of a sound of a perfect interval, specifically 0 o'clock, 5 o'clock, 7 o'clock, and 12 o'clock, c1 is generated by a length of a full sound. The other sounds are generated at lengths of half sounds.

FIG. 4E is a view for explaining a major 3 harmonic-sound forming sound. A major 3 harmonic-sound, as shown in FIG. 4E, is comprised of a root hs1, the third hs3, and the fifth hs5.

The harmonic-sound forming sound adder 108 outputs at least one of the components able to form a major 3 harmonic-sound including the time source "ts" as the output signal s108 to the time announcement sound gate (AND gate) 110 at the time when the time announcement sound "ts" corresponds to for example a black key interval with respect to the basic sound, specifically at 1 o'clock, 3 o'clock, 6 o'clock, 8 o'clock, and 10 o'clock. More specifically, the harmonic-sound forming sound adder 108 outputs other components of the major 3 harmonic-sound to the time source gate (AND gate) 110 so that the time announcement sound "ts" becomes the fifth hs5 of the major 3 harmonic-sound.

The basic sound gate (AND gate) 109 is connected at its input end to the output end of the sounds of a predetermined 12-sounds scale of the frequency divider 105 and the control clock generating circuit 107 and is connected at its output end to the input end of the OR gate 111.

More specifically, for example when a sound of the sound c1 is set as the basic sound "bs", the sound signal c1 from the frequency divider 105 of the sound generator is input to the input end 1091 of the basic sound gate (AND gate) 109. Further, the input end 1092 of the AND gate 109 has input to it a basic sound gate pulse p1 of the output signal s107*a* from the control clock generating circuit 107 as the gate signal.

The basic sound gate (AND gate) 109 is made to pass the sound signal c1 while the basic sound gate pulse p1 is "H" (high level) and outputs this to the OR gate 111 as the output signal s109.

The time-linked sound (time announcement sound) gate (AND gate) 110 is connected at its input end to the control clock generating circuit 107, the sequential switching circuit 106, and the harmonic-sound forming sound adder 108 and is connected at its output end to the OR gate 111. The AND gate 110 is made to pass the output signals of the sequential switching circuit 106 and harmonic-sound forming sound adder 108 while the time-linked sound gate pulse p2 is "H" and outputs the result to the OR gate 111 as an output signal s110.

The OR gate 111 is connected at its input end to the basic sound gate (AND gate) 109 and time source gate (AND gate) 110 and is connected at its output end to the amplifier 112.

The OR gate 111 adds the output signal s109 from the basic sound gate (AND gate) 109, the output signal s106 of the sequential switching circuit 106, and the output signal sloe of the harmonic-sound forming sound adder 108 and outputs the result to the amplifier 112 of the sound generator as an output signal s111.

The amplifier 112 of the sound generator converts the output signal s111 from the OR gate 111 from for example a digital to analog format (D/A), amplifies the result to a predetermined level, and generates a predetermined sound through the speaker 113 of the sound generator.

Figure 5:
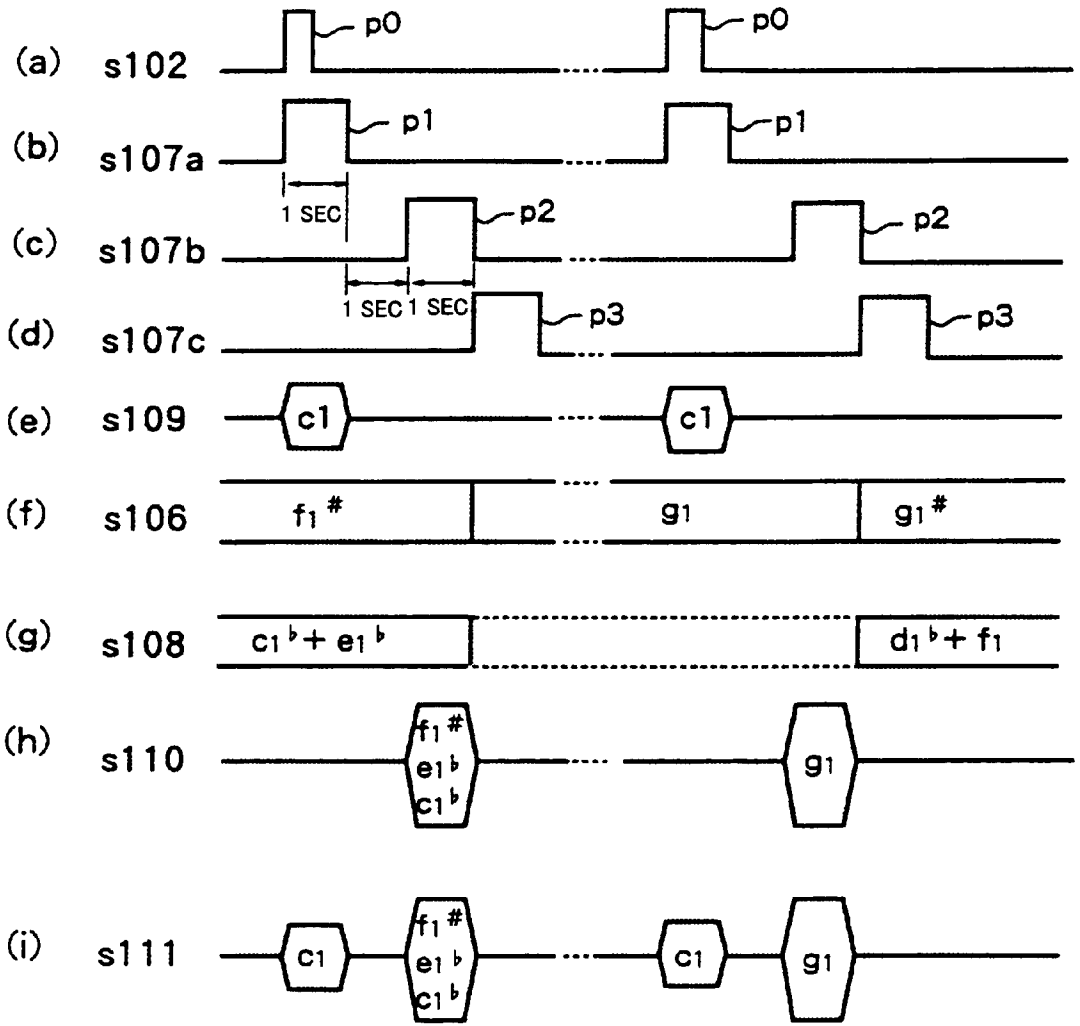
FIGS. 5A to 5I are timing charts for explaining the operation of the sound-scale generation device shown in FIG. 1.

FIGS. 5A to 5I are timing charts for explaining the operation of the sound-scale generation device shown in FIG. 1. FIG. 5A is a chart of the output signal s102 of the clock circuit 102, FIGS. 5B, 5C, and 5D are views of the output signals s107*a*, s107*b*, and s107*c* of the control clock generating circuit 107, FIG. 5E is a view of an output signal s109 of the basic sound gate (AND gate) 109, FIG. 5F is a view of the output signal s106 of the sequential switching circuit 106, FIG. 5G is a view of the output signal s108 of the harmonic-sound forming sound adder 108, FIG. 5H is a view of the output signal s110 of the time announcement sound gate (AND gate) 110, and FIG. 5I is a view of the output signal s111 of the OR gate 111. The operation of the sound-scale generation device 1 will be explained next while referring to FIGS. 5A to 5I.

For example, when the sequential switching circuit 106 is outputting the scale f1♯ to the AND gate 110, the "hour" switching (changing) pulse p0 of the output signal s102 is generated from the clock circuit 102. At this time, as shown in FIGS. 5F and 5G, when the dissonant interval, black key interval scale f1♯ is output from the sequential switching circuit 106 as the output signal s106, the harmonic-sound forming sound adder 108 outputs the sound signals c1$^b$ and e1$^b$ of the components of the major 3 harmonic-sound having the scale f1♯ as the fifth hs5 to the AND gate 110 as the output signal s108.

The control clock generating circuit 107 outputs the basic sound gate pulse p1 as the output signal s107*a* as shown in FIG. 5B, outputs the time-linked sound (time announcement sound) gate pulse p2 as the output signal s107*b* as shown in FIG. 5C after one second, and sequentially outputs the switching timing pulse p3 as the output signal s107*c* as shown in FIG. 5D.

As shown in FIG. 5E, the basic sound gate (AND gate) 109 opens by the basic sound gate pulse p1, and the sound signal c1 is output for exactly 1 second from the AND gate 109 during that interval. Next, as shown in FIGS. 5C and 5H, after a 1-second silent term, the time announcement sound gate (AND gate) 110 opens by the time-linked sound (time announcement sound) gate pulse p2. For that 1 second, the output signal s106 of the sequential switching circuit 106, that is, the sound signal f1♯, and the harmonic-sound forming sounds, that is, the sound signals c1$^b$ and e1$^b$, of the output signal s108 of the harmonic-sound forming sound adder 108, are output.

Further, as shown in FIGS. 5H and 5I, the sound signal c1 and the major 3 harmonic-sound c1$^b$+e1$^b$+f1♯ are sequentially output from the OR gate 111 and generated from the amplifier 112 and the speaker 113 of the sound generator.

Further, as shown in FIG. 5D, right after the sound signal c1 and the major 3 harmonic-sound c1$^b$+e1$^b$+f1♯ are generated, the output signal s106 of the sequential switching circuit 106 is switched from the sound signal f1♯ to the sound signal g1 by the switching timing pulse p3. When the harmonic-sound forming sound adder 108 outputs the sound signal g1 corresponding to a white key interval by the perfect interval with respect to the basic sound "bs" of c1 as the output signal s106 from the sequential switching circuit 106, it does not output the output signal of the harmonic-sound forming sounds.

Further, when 1 hour passes and an "hour" switching pulse p0 is again generated as an output signal s102 from the clock circuit 102, in the same way as the above, the basic sound gate pulse p1, time-linked sound (time announcement sound) gate pulse p2, and switching timing pulse p3 are successively generated. The time-linked sound (time announcement sound "ts") generated at this time becomes the sound of the sound signal g1. The output signal s106 at the sequential switching circuit 106 is switched from the sound signal g1 to the sound signal g1♯.

When the harmonic-sound forming sound adder 108 outputs the sound signal g1♯ corresponding to a black key interval by an imperfect consonant interval with respect to the basic sound "bs" of c1 as the output signal s106 from the sequential switching circuit 106, it outputs the scale d1$^b$ and the scale f1 of the components of the major 3 harmonic-sound having the scale g1♯ as the fifth hs5 to the time announcement sound gate (AND gate) 110.

Figure 4:
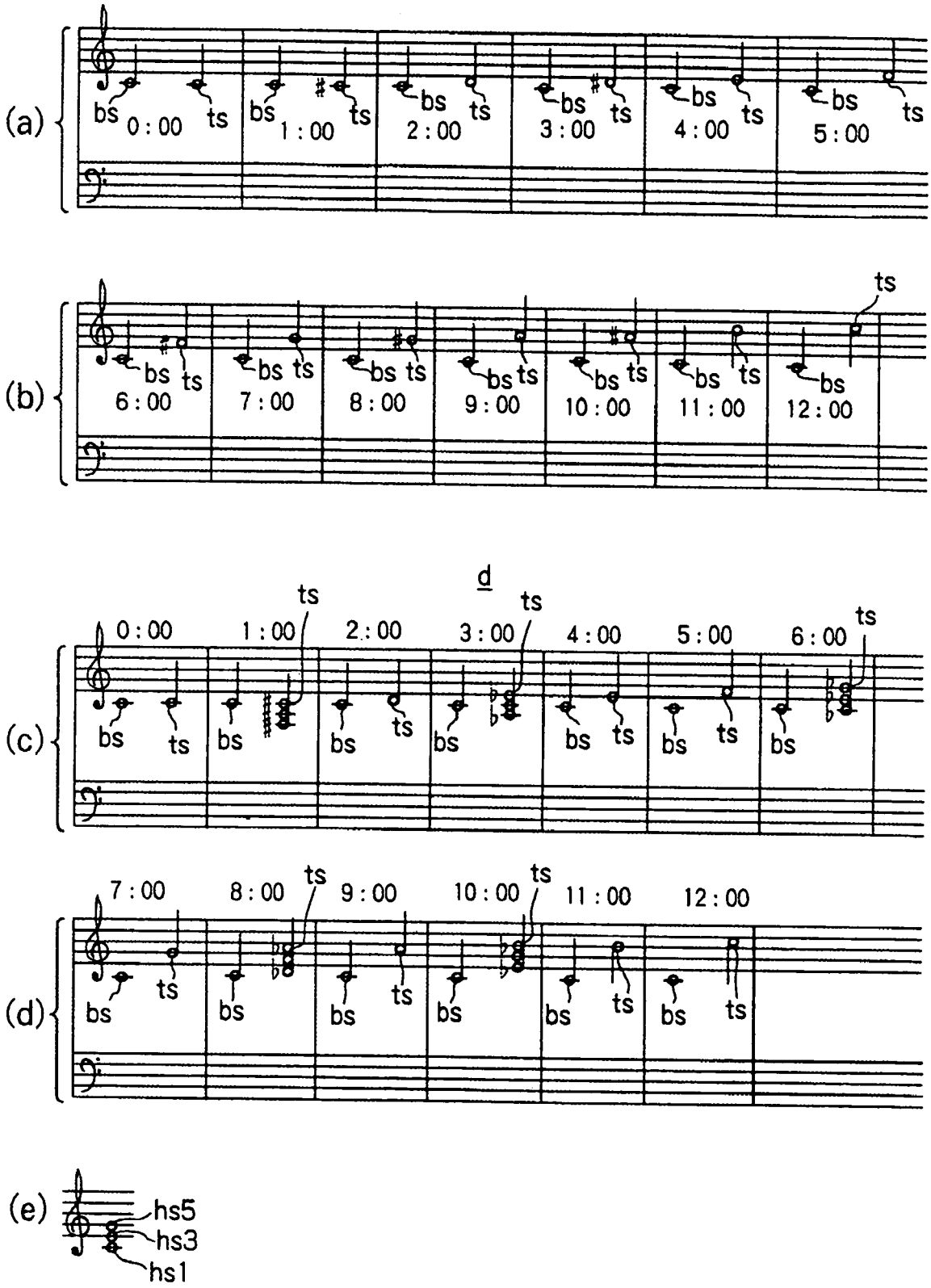
FIGS. 4A to 4E are views for explaining the generation of sounds of the sound-scale generation device shown in FIG. 1.

Here, when initializing the output signal s106 of the sequential switching circuit 106 so that the time-linked sound (time announcement sound "ts") of 0 o'clock becomes the sound signal c1, as shown in FIG. 4, it generates c1, c1 at 0 o'clock, generates c1, f♯+a♯+c1♯ at 1 o'clock, generates c1, d1 at 2 o'clock, generates c1, a$^b$+c1+e1$^b$ at 3 o'clock, generates c1, e1 at 4 o'clock, generates c1, f1 at 5 o'clock, generates c1, c1$^b$+e1$^b$+g1$^b$ at 6 o'clock, generates c1, g1 at 7 o'clock, generates c1, d1$^b$+f1+a1$^b$ at 8 o'clock, generates c1, a1 at 9 o'clock, generates c1, e1$^b$+g1+b1$^b$ at 10 o'clock, generates c1, b1 at 11 o'clock, and generates c1, c2 at 0 o'clock from the speaker 113 at each time.

As explained above, since the clock circuit 102 generating a sound generation instruction signal at a fixed time such as every hour, the frequency divider 105 serving as the sound generator able to generate at least a 12-sounds scale, an amplifier 112, the speaker 113, the sequential switching circuit 106 linking the sounds of the 12-sounds scale and times corresponding to the fixed time and controlling the sound generator so as to generate a basic sound "bs" of one of the 12-sounds scale, then generate one of the scale-forming-sounds corresponding to a time which is every time when receiving a sound generation instruction signal, and a harmonic-sound forming sound adder 108 controlling the sound generator so as to generate a sound by superposing at least one of the harmonic-sound forming sounds able to form a harmonic-sound including the scale-forming-sound when the sequential switching circuit 106 makes the sound generator generate at least a scale-forming-sound of a dissonant interval and/or imperfect consonant interval with respect to the basic sound "bs" are provided, it is possible to eliminate the unpleasantness when a dissonantly reverberating dissonant interval or imperfect consonant interval is generated.

In particular, the harmonic-sound forming sound adder 108 outputs harmonic-sound forming sounds of a major 3 harmonic-sound so as to obtain a major 3 harmonic-sound including the time announcement sound "ts" and making the speaker 113 generate a sound at 1 o'clock, 3 o'clock, 6 o'clock, 8 o'clock, and 10 o'clock, so the major 3 harmonic-sound is a cheerful reverberation (harmonic-sound of c, d, e). Due to its cheerfulness, it is possible to reduce the dissonant reverberation to about one-quarter psychologically.

Further, even if generating a major 3 harmonic-sound including the time announcement sound "ts" corresponding to a predetermined time, a user can listen to the time announcement sound "ts" and can easily recognize the time from the interval between the basic sound "bs" and the time announcement sound "ts".

Further, the harmonic-sound forming sound adder 108 outputs a component of the major 3 harmonic-sound, that is, the time announcement sound "ts", so that the time announcement sound "ts" becomes a component of the fifth hs5 of the major 3 harmonic-sound and makes the speaker 113 generate a major 3 harmonic-sound including the time announcement sound "ts", so a user can simply differentiate a time announcement sound "ts" from a harmonic-sound including the time announcement sound "ts".

For example, in the case of 1 o'clock, the user is made to learn the augmented 1st of c to c♯ (also minor 2nd, same sound though different name in equal temperament) by the time announcement sound "ts", then can listen and recognize c to c♯ without feeling any unpleasantness. The component first at the top, that is, the fifth hs5 of the 3 harmonic-sound, can be heard most easily among the three components.

Further, at the time corresponding to the time announcement sound "ts" of the black key interval, a harmonic-sound including the time announcement sound "ts" is generated from the speaker 113, so the user can discriminate the time much more easily. Specifically, the time announcement sound "ts" is generated substantially alternately as a harmonic-sound and pure tone from 1 o'clock to 12 o'clock, so discrimination between adjoining times becomes easy.

For example, when the time-linked sound after generating the basic sound "bs" is a harmonic-sound, the user discriminates that the time is one of 1 o'clock, 3 o'clock, 6 o'clock, 8 o'clock, and 10 o'clock. This is because, for example, at 6 o'clock shown by a harmonic-sound, it is difficult to believe that the user would misunderstand it as 8 o'clock or 3 o'clock (pure tones are generated at 7 o'clock and 5 o'clock, so misunderstanding is avoided. The adjoining times when harmonic-sounds are generated are 8 o'clock and 3 o'clock, but it is difficult to misunderstand 6 o'clock as 8 o'clock or 3 o'clock in the pace of daily life).

For example, when monitoring the sound-scale generation device 1 according to the present embodiment, compared with the case of generating sounds as shown by FIGS. 4A and 4B, by generating sounds as shown in FIGS. 4C and 4D, a user can easily discriminate between a time corresponding to the black key interval and a time corresponding to the white key interval. Further, it is possible to eliminate the unpleasantness of a time announcement sound "ts" of a dissonant interval and imperfect consonant interval.

Further, a normal person can recognize the time by viewing a faceplate of the clock, but the visually impaired cannot see it, so ease of differentiation of the time announcement sound "ts" is important. The sound-scale generation device 1 according to the present embodiment has the effect of enabling easy recognition of the time and eliminating the work of counting the number of time announcement sounds which had been troublesome in daily life for the visually impaired.

Second Embodiment

Figure 6:
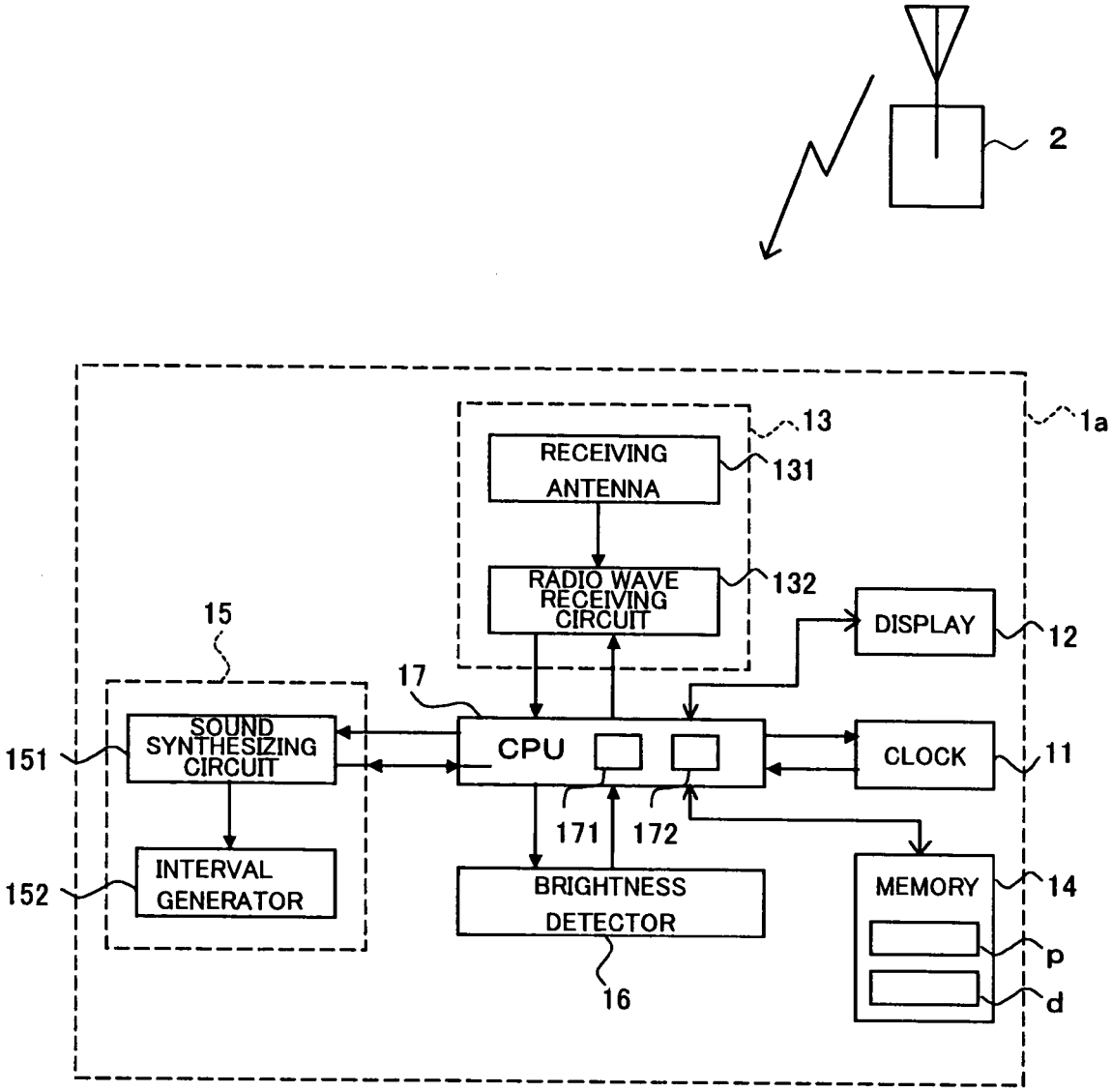
FIG. 6 is a functional block diagram of a second embodiment of a sound-scale generation device according to the present invention.

FIG. 6 is a functional block diagram of a second embodiment of a sound-scale generation device according to the present invention. For example, the sound-scale generation device 1*a* generates a basic sound "bs" and time announcement sound "ts" from the scale-forming-sounds of the 12-sounds scale at fixed times. Further, it modifies time information counted inside based on standard time information provided from a standard time information station 2.

The sound-scale generation device 1*a*, as shown in FIG. 6, has a clock 11, a display 12, a communicator 13, a memory 14, a sound generator 15, a brightness detector 16, and a central processing unit (CPU) 17 of a computer. The sound generator 15 corresponds to the sound generator according to the present invention.

The clock 11 counts the time and outputs time information to the CPU 17. The CPU 17 makes the display 12 display an image corresponding to the time information output from the clock 11 and makes the sound generator 15 generate a sound in accordance with the time information. For example, the clock 11 generates a sound generation instruction signal at a fixed time such as every hour, eg, 0 o'clock, 1 o'clock, etc., and outputs it to the CPU 17.

The display 12 performs a display relating to the announcement time and announcement. The communicator 13 receives a standard time information provided from for example the standard time information station 2 and outputs it to the CPU 17 under the control of the CPU 17. The CPU 17 modifies the time information counted at the clock 11 based on the standard time information. For example, the case of the standard time information station 2 transmitting a standard radio-frequency wave including the standard time information will be explained.

The communicator 13 has for example a receiving antenna 131 and a radio-frequency wave receiving circuit 132. The receiving antenna 131 receives a standard radio-frequency wave transmitted from the standard time information station 2 and outputs it to the radio-frequency wave receiving circuit 132.

The radio-frequency wave receiving circuit 132 extracts the standard time information included in the standard radio-frequency wave and outputs it to the CPU 17 based on the standard radio-frequency wave received at the receiving antenna 131. For example, the radio-frequency wave receiving circuit 132 is comprised of a not shown RF amplifier, a wave detection circuit, a rectifier circuit, and an integration circuit.

The memory 14 stores a program "pr" or data "d" relating to an announcement corresponding to a time and reads these or writes predetermined data under the control of the CPU 17. Further, the memory 14 is also used as a work region when the CPU 17 executes a program "p".

The program "p" is executed in the CPU 17 and has a routine for processing relating to an announcement corresponding to the time. The data "d" includes predetermined times for making the sound generator 15 generate a sound and sounds to be made to be generated at the sound generator 15, specifically a basic sound "bs" and time announcement sound "ts" linked together. For example, the data "d", as shown in FIGS. 4C and 4D, is stored by linking the predetermined times and the basic sounds bs and time announcement sounds "ts".

The sound generator 15 can generate a 12-sounds scale in the same way as the sound-scale generation device 1 according to the first embodiment under the control of the CPU 17. The sound generator 15 generates a basic sound "bs" and time announcement sound "ts" in the scale-forming-sounds of the 12-sounds scale as explained above. The sound generator 15 more specifically has a sound synthesizing circuit 151 and a sound-interval generator 152.

The sound synthesizing circuit 151 synthesizes a sound signal corresponding to the control signal of the CPU 17 and outputs it to the interval generator 152 when receiving as input for example a control signal from the CPU 17 for generating a sound corresponding to a predetermined time. For example, the sound synthesizing circuit 151 is a pulse code modulation (PCM) sound source for outputting a sound digitalized by the PCM system or another sound source.

The interval generator 152 generates a sound based on the sound signal output from the sound synthesizing circuit 151. For example, the interval generator 152 has an amplification circuit for amplifying the sound signal output from the sound synthesizing circuit to a predetermined level and the speaker generating a sound corresponding to the sound signal output from the amplification circuit.

The brightness detector 16 detects a bright state and a dark state etc and outputs a signal showing the result of the detection to the CPU 17. The brightness detector 16 is for example a CdS photosensor or other photosensor. The CPU 17 makes the sound generator 15 generate a basic sound "bs" and time announcement sound "ts" corresponding to the brightness state detected by the brightness detector 16.

The CPU 17 of the computer for example performs processing relating to announcement of the time based on the program "p" stored in the memory 14. The CPU 17 for example has a sound generating controller 171 and a harmonic-sound forming sound adder 172. The sound generating controller 171 corresponds to the sound generating controller according to the present invention, while the harmonic-sound forming sound adder 172 corresponds to the harmonic-sound forming sound adder according to the present invention.

The sound generating controller 171 controls the sound generator 15 so as to generate a basic sound "bs" of one sound of the 12-sounds scale, then generate sound signals corresponding to a time of each time at which a sound generation instruction signal is received from the clock 11 based on the correspondence between the sounds of the 12-sounds scale stored in the memory 14 and times corresponding to the fixed time.

The harmonic-sound forming sound adder 172 controls the sound generator 15 so as to generate at least one of the harmonic-sound forming sounds able to form a harmonic-sound including that scale-forming-sound when the sound generating controller 171 causes the sound generator 15 to generate at least a scale-forming-sound of a dissonant interval and imperfect consonant interval with respect to the basic sound "bs".

For example, the harmonic-sound forming sound adder 172 adds at least one of the harmonic-sound forming sounds able to form a harmonic-sound including the time announcement sound "ts" to the time announcement sound "ts" to make the sound generator 15 generate a sound when the time announcement sound "ts" is a sound corresponding to the black key interval with respect to the basic sound "bs".

Specifically, the harmonic-sound forming sound adder 172, as shown in FIGS. 4A to 4E, adds a component able to form a major 3 harmonic-sound including the time announcement sound 5*s* to the time announcement sound "ts" to make the sound generator 15 generate a sound. More specifically, the harmonic-sound forming sound adder 172 adds another component of the major 3 harmonic-sound so that the time announcement sound "ts" becomes the fifth hs5 of the major 3 harmonic-sound to make the sound generator 15 generate a sound.

Figure 7:
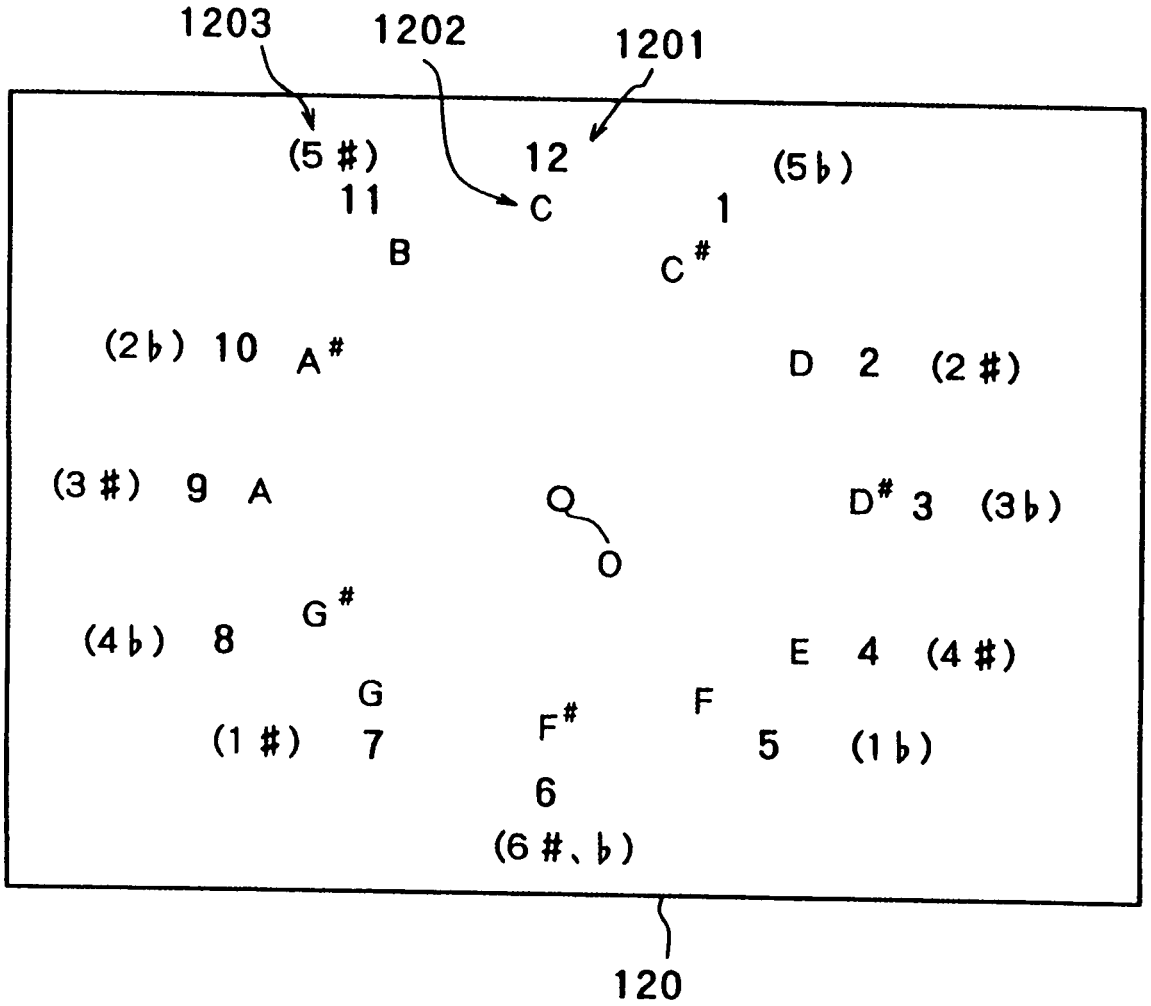
FIG. 7 is a front view of a display of the sound-scale generation device shown in FIG. 6.

FIG. 7 is a front view of a display of a sound-scale generation device shown in FIG. 6. The display 12, as shown for example in FIG. 7, has a time display 1201, a scale display 1202, and a key signature display 1203 on the faceplate 120.

The time display 1201 is provided with marks showing the times of 1 o'clock to 0 o'clock surrounding the center position o of the faceplate 120. The scale display 1202 is provided with marks showing the scale-forming-sounds of the 12-sounds scale of C, C♯, D, D♯, E, F, F♯, G, G♯, A, A♯, and B at positions corresponding to the time display 1201.

The key signature display 1203 for example is provided with marks showing $5^b$, 2♯, $3^b$, 4♯, $1^b$, (6♯, $^b$), 1♯, $4^b$, 3♯, $2^b$, and 5♯ at positions corresponding to 1 o'clock to 11 o'clock of the time display 1201.

The display 12 of the above configuration can be used for teaching pitch and scales. For example, a parallel key (meaning relationship of major and minor keys having the same key signatures) can be relatively shown by the positional relationship of 9 o'clock on the faceplate 120.

Specifically, a sound displayed at a position corresponding to the time shown by the minute hand at the sound generator 1202 indicates a major key and a sound displayed at a position corresponding to the time shown by the hour hand indicates a minor key. For example, when a user opens the thumb and index finger of his right hand 90 degrees and uses his index finger to indicate a desired major key at the scale display 1202 indicated on the faceplate 120, the sound displayed at the position indicated by his thumb indicates a minor key.

The key signature can be taught by the indication on the key signature display 1203. For example, the 2♯ displayed on the key signature display 1203 means D and Dur (double major key) means two ♯'s are attached to the key signature. For example, the ♯ system consists of F, J, G, D, H, E, and I and ♯ marks attached in the right direction. By the display of the key signature display 1203 in this way, it is possible for a user to learn the method of attachment of the ♯ marks and $^b$ marks.

A user can recognize the current time based on the correspondence between the intervals between the basic sound "bs" and the time announcement sound "ts" generated from the sound generator 15 and the times and scales displayed at the time display 1201 and the scale display 1202 of the faceplate 120.

Figure 8:
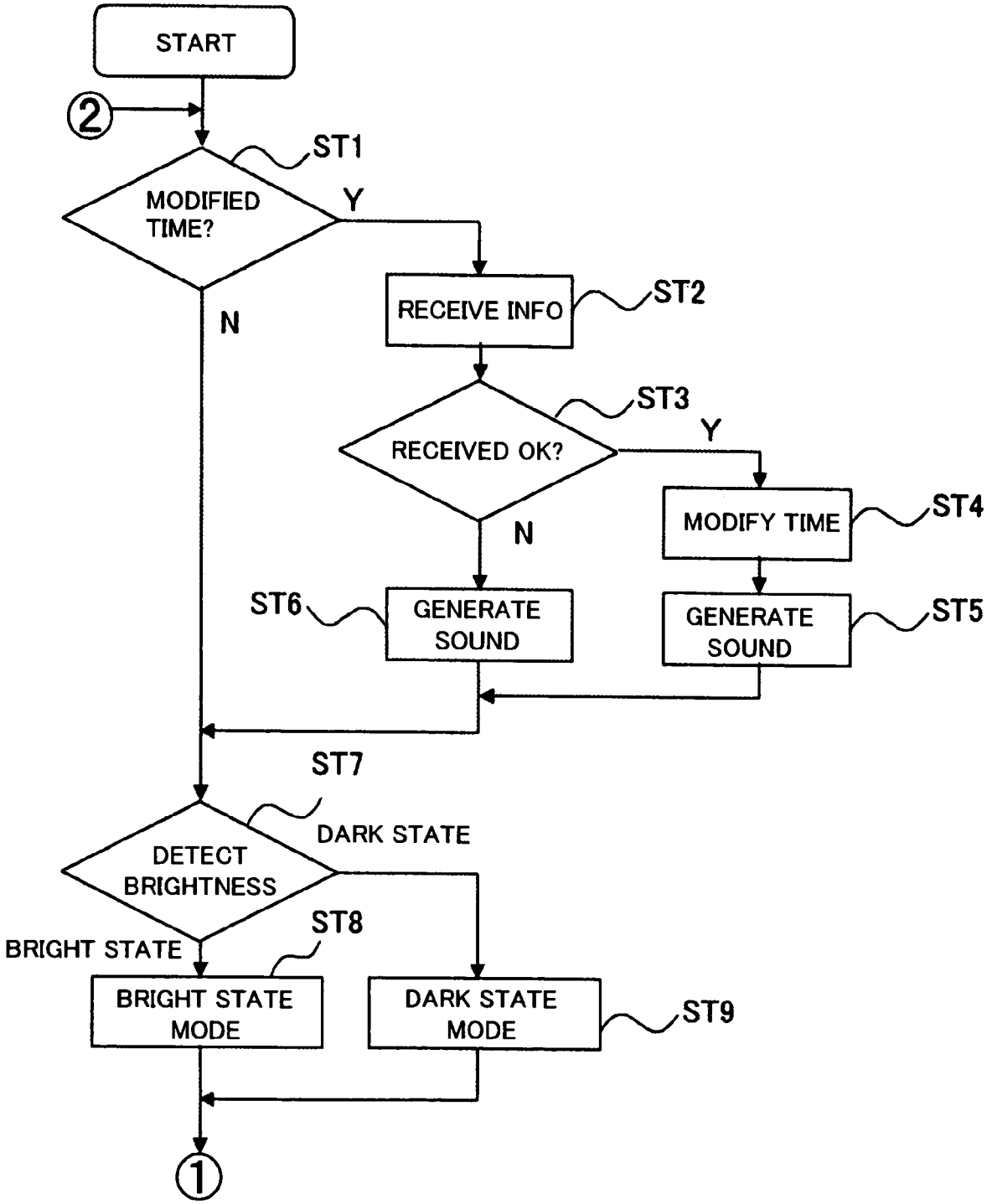
FIG. 8 is a flow chart for explaining the operation of the sound-scale generation device shown in FIG. 6.
Figure 9:
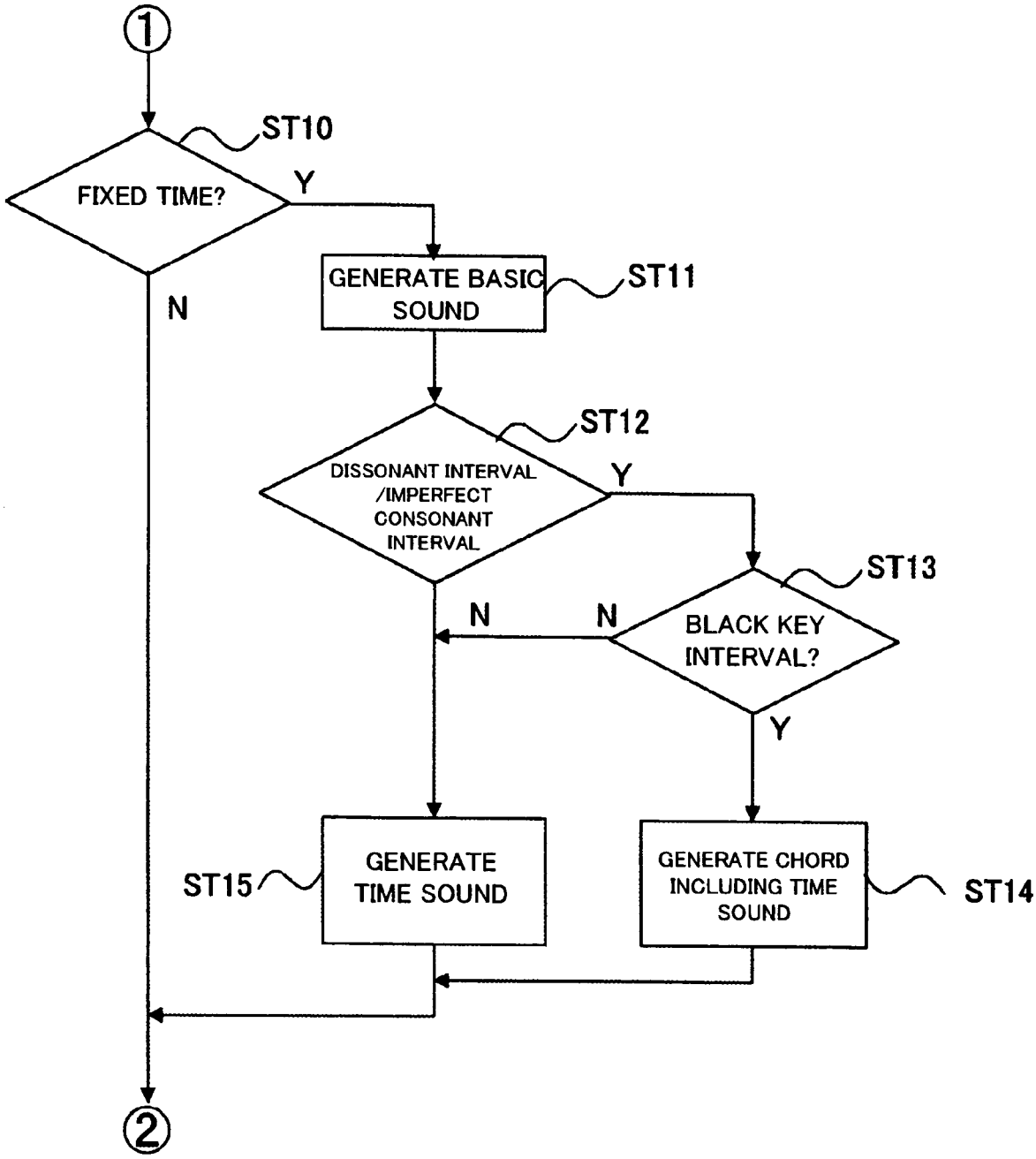
FIG. 9 is a flow chart for explaining the operation of the sound-scale generation device shown in FIG. 6.

FIGS. 8 and 9 are flow charts for explaining the operation of the sound-scale generation device shown in FIG. 6. The operation of the sound-scale generation device 1 of the above configuration will be explained focusing on the operation of the CPU 17 while referring to FIGS. 8 and 9.

At step ST1, the CPU 17 judges if the time is a modified time based on the time information counted by the clock 11. When it judges it to be a modified time, it has the radio-frequency wave receiving circuit 132 of the communicator 13 receive the standard time information transmitted from the standard time information station 2 through the receiving antenna 131.

At step ST3, the CPU 17 judges if the standard time information has been normally received. When it has been normally received, it modifies the time information counted by the clock 11 based on the standard time information (ST4), makes the sound generator 15 generate a sound showing that it was able to normally receive the information (ST5), then proceeds to the processing of step ST7.

On the other hand, when the standard time information has not been normally received at the judgment at step ST3, it makes the sound generator 15 generate a sound to the effect that the information could not be normally received (ST6) and then proceeds to the processing of step ST7. On the other hand, even when it is judged that the time is not a modified time at the judgment of step ST1, the CPU 17 proceeds to the processing of step ST7.

At step ST7, the CPU 17 detects if the state is a bright state or dark state by the brightness detector 16. Specifically, the CPU 17 shifts to the bright state mode when it detects the bright state by the brightness detector 16 (ST8) and shifts to the dark state mode when it detects the dark state (ST9).

In the dark state mode, for example the CPU 17 performs processing relating to an announcement corresponding to the dark state. For example, the CPU 17 makes the sound generator 15 generate a sound by a volume smaller than the case of the bright state mode.

On the other hand, in the bright state mode, for example the CPU 17 performs processing relating to an announcement corresponding to the bright state. For example, the CPU 17 makes the sound generator 15 generate a sound by a volume larger than the case of the dark state mode.

At step ST10, the CPU 17 judges if the time is a fixed time. Specifically, the CPU 17 outputs a sound generation instruction signal from the clock 11 and judges if the time is a predetermined announcement time based on the time information counted by the clock 11 and the data "d" stored in the memory 14. When it judges that the time is a fixed time, the sound generating controller 171 of the CPU 17 makes the sound generator 15 generate a basic sound "bs" (ST11).

At step ST12, the harmonic-sound forming sound adder 172 of the CPU 17 judges if the time announcement sound "ts" to be made to be generated at that time is a time announcement sound "ts" of a dissonant interval and/or imperfect consonant interval with respect to the basic sound "bs". Specifically, the harmonic-sound forming sound adder 172 of the CPU 17, as shown in for example FIGS. 4C and 4D, judges if the time announcement sound "ts" to be made to be generated at that time is a time announcement sound "ts" of a dissonant interval and/or imperfect consonant interval with respect to the basic sound "bs" based on the data "d" stored in the memory 14.

When judging that the time announcement sound "ts" is a time announcement sound "ts" of a dissonant interval and/or imperfect consonant interval with respect to the basic sound "bs", the harmonic-sound forming sound adder 172 of the CPU 17 judges if the time announcement sound "ts" is a black key interval (ST13).

In the judgment of step ST13, when judging that the time announcement sound "ts" is a black key interval, the harmonic-sound forming sound adder 172 adds at least one of the components able to form a harmonic-sound including the time announcement sound "ts", for example, the major 3 harmonic-sound, to the time announcement sound "ts" to make the sound generator 15 generate a sound (ST14) and returns to the processing of step ST1.

On the other hand, when it judges that the time announcement sound "ts" to be made to be generated at that time is not a time announcement sound "ts" of a dissonant interval and/or imperfect consonant interval with respect to the basic sound "bs" in the judgment of step ST12 and when it judges that the time announcement sound "ts" is not a black key interval at step ST13, the sound generating controller 171 makes the sound generator 15 generate the time announcement sound "ts" by a pure tone and returns to the processing of step ST1.

As explained above, since the sound generator 15, the memory 14 storing the correspondence between the sounds of the 12-sounds scale and the times corresponding to the fixed time, the sound generating controller 171 controlling the sound generator 15 so as to generate a basic sound "bs" of one sound of the 12-sounds scale, then generate a scale-forming-sound corresponding to that time each time a sound generation instruction signal is received, and a harmonic-sound forming sound adder 172 controlling the sound generator 15 to generate at least one of the harmonic-sound forming sounds able to form a harmonic-sound including that scale-forming-sound when the sound generating controller 17 makes the sound generator 15 generate at least a scale-forming-sound of a dissonant interval and/or imperfect consonant interval with respect to the basic sound "bs" are provided, it is possible to eliminate the unpleasantness when a dissonant interval or imperfect consonant interval with dissonant reverberation is generated.

Further, since a communicator 13 receiving standard time information provided from the standard time information station 2 is provided and the CPU 17 modifies the time information counted by the clock 11 based on the standard time information, it is possible to make the basic sound "bs" and the time announcement sound "ts" be accurately generated at an accurate timing.

Further, since a brightness detector 16 is provided and the CPU 17 makes the sound generator 15 generate the basic sound "bs" and time announcement sound "ts" corresponding to the brightness state detected by the brightness detector 16, if it makes the generator generate a sound by a volume lower than the bright state mode at the time of for example the dark state mode, the user can sleep without worrying about the basic time bs and the time announcement sound "ts" when providing the sound-scale generation device 1*a* in his room and darkening the room when sleeping.

Further, since a faceplate 120 linking times and the scale is provided, a user can easily discriminate the time from the time announcement sound "ts" by viewing the faceplate 120. Further, he can efficiently learn a scale by listening to the basic sounds bs and the time announcement sounds "ts" and viewing the faceplate 120.

Third Embodiment

FIGS. 10A and 10B are views for explaining the basic sound "bs" and time announcement sound "ts" corresponding to predetermined times for generating a sound of a third embodiment of a sound-scale generation device according to the present invention. The sound-scale generation device 1*b* according to the present invention is configured substantially the same as the sound-scale generation device 1*a* according to the second embodiment, so only the points of difference will be explained. For example, the sound-scale generation device 1*b* makes the sound generator 15 generate a sound by superposing a sound more than an octave or a sound less than an octave when generating the basic sound "bs". For example, the case of generating a sound by superposing a sound less than an octave on the basic sound "bs" will be explained.

The memory 14 has the data ""db"". The data "db", for example as shown in FIGS. 10A and 10B, stores the predetermined times to be made to be generated at the sound generator 15 and the sounds made to be generated at the sound generator 15, specifically the basic sounds "bs" and time announcement sounds, linked together.

The sound generating controller 171 of the CPU 17 controls the sound generator 15 so as to generate a sound by superposing a sound less than an octave on a basic sound "bs" based on the data "db" when making the sound generator 15 generate a basic sound "bs".

Specifically, the CPU 17, as shown in FIGS. 10A and 10B, generates c+c1, c1 at 0 o'clock, generates c+c1, f♯a♯+c1♯ at 1 o'clock, generates c+c1, d1 at 2 o'clock, generates c+c1, $a^b$+c1+e1$^b$ at 3 o'clock, generates c+c1, e1 at 4 o'clock, generates c+c1, f1 at 5 o'clock, generates c+c1, c1$^b$+e1$^b$+g1$^b$ at 6 o'clock, generates c+c1, g1 at 7 o'clock, generates c+c1, d1$^b$+f1+a1$^b$ at 8 o'clock, generates c+c1, a1 at 9 o'clock, generates c+c1, e1$^b$+g1+b1$^b$ at 10 o'clock, generates c+c1, b1 at 11 o'clock, and generates c+c1, c2 at 12 o'clock based on the data "db" stored in the memory 14 through the sound generator 15.

FIG. 10C is a view for explaining a sound generated every 30 minutes from the sound generator of the sound-scale generation device 1. The CPU 17 causes the sound generator 15 to generate a sound different from the hour. Specifically, for example, the CPU 17, as shown in FIG. 10C, generates a basic sound "bs" of c1 at the half hour as the length of an eighth sound, then generates a sound of g1 as a sound of a length of an eighth sound and half sound.

As explained above, the sound-scale generation device 1*b* can eliminate the reverberation of a basic sound easily becoming monotonous since the sound generating controller 171 of the CPU 17 controls the sound generator 15 so as to generate a sound by superposing a sound less than an octave on a basic sound "bs" when generating the basic sound "bs".

The sound-scale generation device 1*a* according to the second embodiment does not generate a sound by superposing a basic sound "bs" and time announcement sounds to lighten the unpleasantness of the dissonant interval and imperfect consonant interval, but the sound-scale generation device 1*b* makes the sound generator 15 generate a sound by superposing the basic sound "bs" and the time announcement sound "ts" at times corresponding to the time announcement sound "ts" of the perfect consonant interval, specifically 0 o'clock, 5 o'clock, 7 o'clock, and 12 o'clock, so a user can easily distinguish between for example the adjoining 4 o'clock and 5 o'clock. Further, the sound-scale generation device 1*b* generates a sound different from the hour every half hour, so a user can distinguish and recognize the hour and half hour.

Fourth Embodiment

Figure 11:
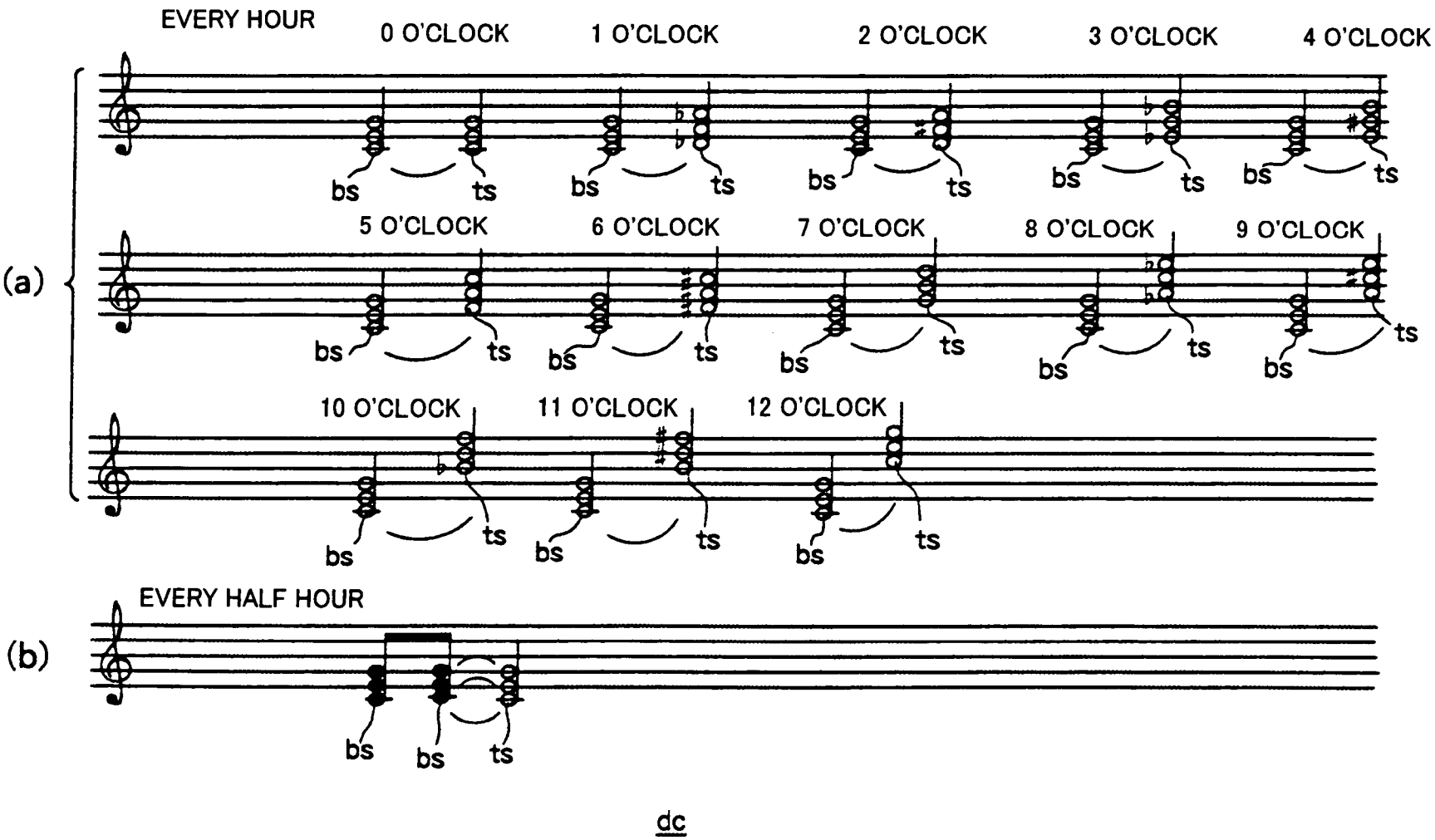
FIGS. 11A and 11B are views for explaining basic sounds and time announcement sounds corresponding to predetermined times announced in a fourth embodiment of a sound-scale generation device according to the present invention.

FIGS. 11A and 11B are views for explaining the basic sound and time announcement sound corresponding to a predetermined time for announcement of time of a fourth embodiment of the sound-scale generation device according to the present invention. The sound-scale generation device 1*c* according to the present invention is configured substantially the same as the sound-scale generation device 1*a* according to the second embodiment, so only the points of difference will be explained. @

The memory 14 has data "dc". The data "db", for example as shown in FIGS. 11A and 11B, includes the predetermined times for making the sound generator 15 generate a sound and the sounds made to be generated by the sound generator 15, more specifically the basic sounds "bs" and the time announcement sounds "ts", stored linked together.

The CPU 17, as shown in FIG. 11A, generates c1+e1+g1, c1+e1+g1 at 0 o'clock, generates c1+e1+g1, d1$^b$+f1+a1$^b$ at 1 o'clock, generates c1+e1+g1, d1+f1♯+a1 at 2 o'clock, generates c1+e1+g1, e1$^b$+g1+b1$^b$ at 3 o'clock, generates c1+e1+g1, e1+g1♯+b1 at 4 o'clock, generates c1+e1+g1, f1+a1+c2 at 5 o'clock, generates c1+e1+g1, f1♯+a1♯+C2♯ at 6 o'clock, generates c1+e1+g1, g1+b1+d2 at 7 o'clock, generates c1+e1+g1, a1$^b$+c2+e2$^b$ at 8 o'clock, generates c1+e1+g1, a1+c2♯+e2 at 9 o'clock, generates c1+e1+g1, b1$^b$+d2+f2 at 10 o'clock, generates c1+e1+g1, b1+d2♯+f2♯ at 11 o'clock, and generates c1+e1+g1, c2+e2+g2 at 12 o'clock based on the data "db" stored in the memory 14 through the sound generator 15. Here, the lengths of generation of the basic sound "bs" and the time announcement sound "ts" are lengths of half sounds. Further, every 30 minutes, the CPU 17, as shown in FIG. 11B, makes the sound generator 15 generate a sound.

The sound-scale generation device 1*c* makes the sound generator 15 generate a harmonic-sound including the basic sound "bs" and a harmonic-sound including the time announcement sound "ts", specifically the major 3 harmonic-sound, so a more balanced reverberation can be obtained. Further, since a major 3 harmonic-sound using the basic soenerated for the time announcement sound "ts" as the root hs1 is made to be generated from the sound generator 15, the user can easily listen to the basic sound "bs" and the time announcement sound "ts" and simply recognize the time.

Fifth Embodiment

Figure 12:
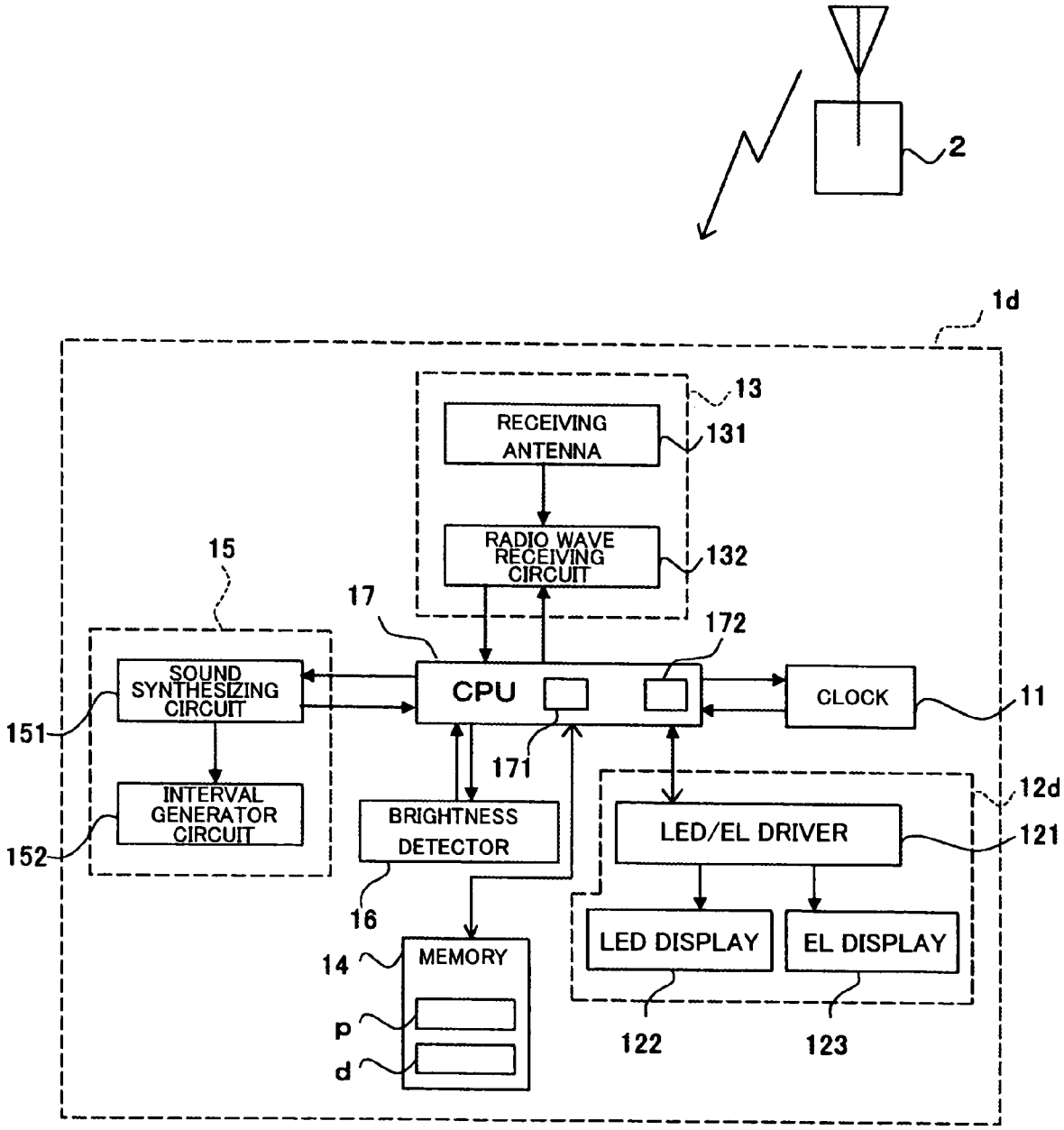
FIG. 12 is a functional block diagram of a fifth embodiment of a sound-scale generation device according to the present invention.

FIG. 12 is a functional block diagram of a fifth embodiment of a sound-scale generation device according to the present invention. The sound-scale generation device 1*d* according to the present embodiment, as shown in FIG. 12, has a clock 11, a display 12*d*, a communicator 13, a memory 14, a sound generator 15, a brightness detector 16, and a CPU 17. The sound-scale generation device 1*d* is configured substantially the same as the sound-scale generation device 1*a* according to the second embodiment. Only the points of difference will be explained.

The display 12*d* has a driver 121, a light emitting diode (LED) display 122, and an electroluminescence (EL) display 123. The LED display 122 corresponds to the time light emitting means according to the present invention, while the EL display 123 corresponds to the center position light emitting means according to the present invention.

The driver 121 outputs a drive signal to the LED display 122 and outputs a drive signal to the EL display 123 to drive them under the control of the CPU 17. The LED display 122 operates corresponding to the drive signal output from the CPU 17 through the driver 121. The EL display 123 changes in brightness in accordance with the drive signal output from the CPU 17 through the driver 121. The EL display 123 is for example configured by organic EL.

Figure 13:
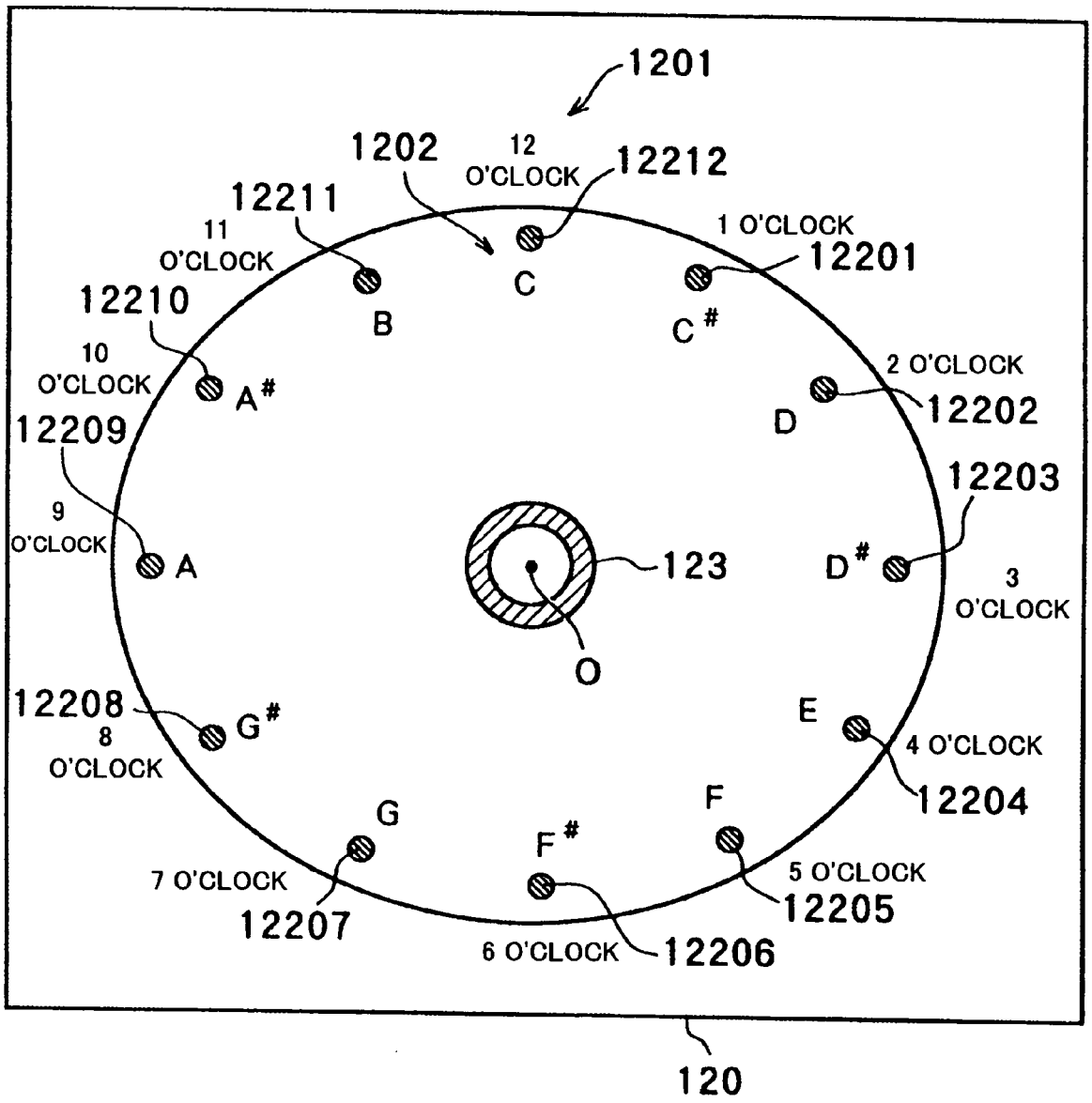
FIG. 13 is a front view of a sound-scale generation device shown in FIG. 12.

FIG. 13 is a front view of a sound-scale generation device shown in FIG. 12. The LED display 122 has a plurality of LEDs 1201 to 12212. For example, the LED display 122, as shown in FIG. 13, is provided between a time display 1201 and scale display 1202 of the faceplate 120 of the sound-scale generation device with a plurality of LEDs 12201 to 12212 at substantially equal intervals in a substantially circular shape so as to correspond to the positions of 1 o'clock to 12 o'clock of the time display 1201 so as to surround the EL display 123 around the center position o.

The EL display 123, for example as shown in FIG. 13, is provided substantially concentrically circularly about the center position o near the center position o. The EL display 123 is provided to emit light and show the center point o when in for example the dark state mode.

For example, the CPU 17 makes the sound generator 15 generate the basic sound "bs" and makes the EL display 123 emit light through the driver 121 when announcing the time at a predetermined time. After a predetermined time, the CPU 17 makes the sound generator 15 generate a time announcement sound "ts" corresponding to a predetermined time and makes the LEDs 12201 to 12212 of the LED display 122 light up for a predetermined time based on that predetermined time and time announcement sound "ts" through the driver 121.

Figure 10:
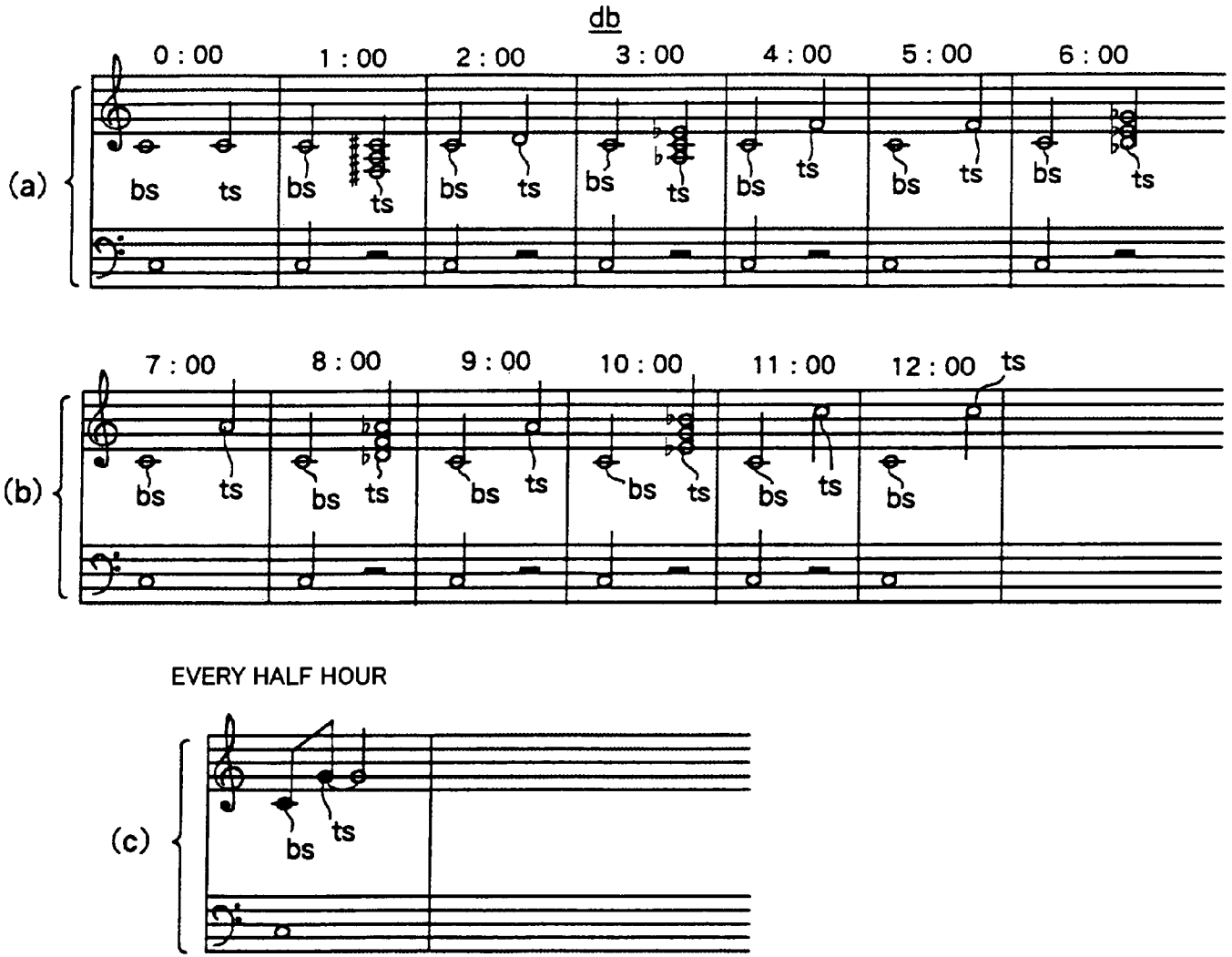
FIGS. 10A, 10B, and 10C are views for explaining basic sounds and time announcement sounds corresponding to predetermined times announced in a third embodiment of a sound-scale generation device according to the present invention.
Figure 14:
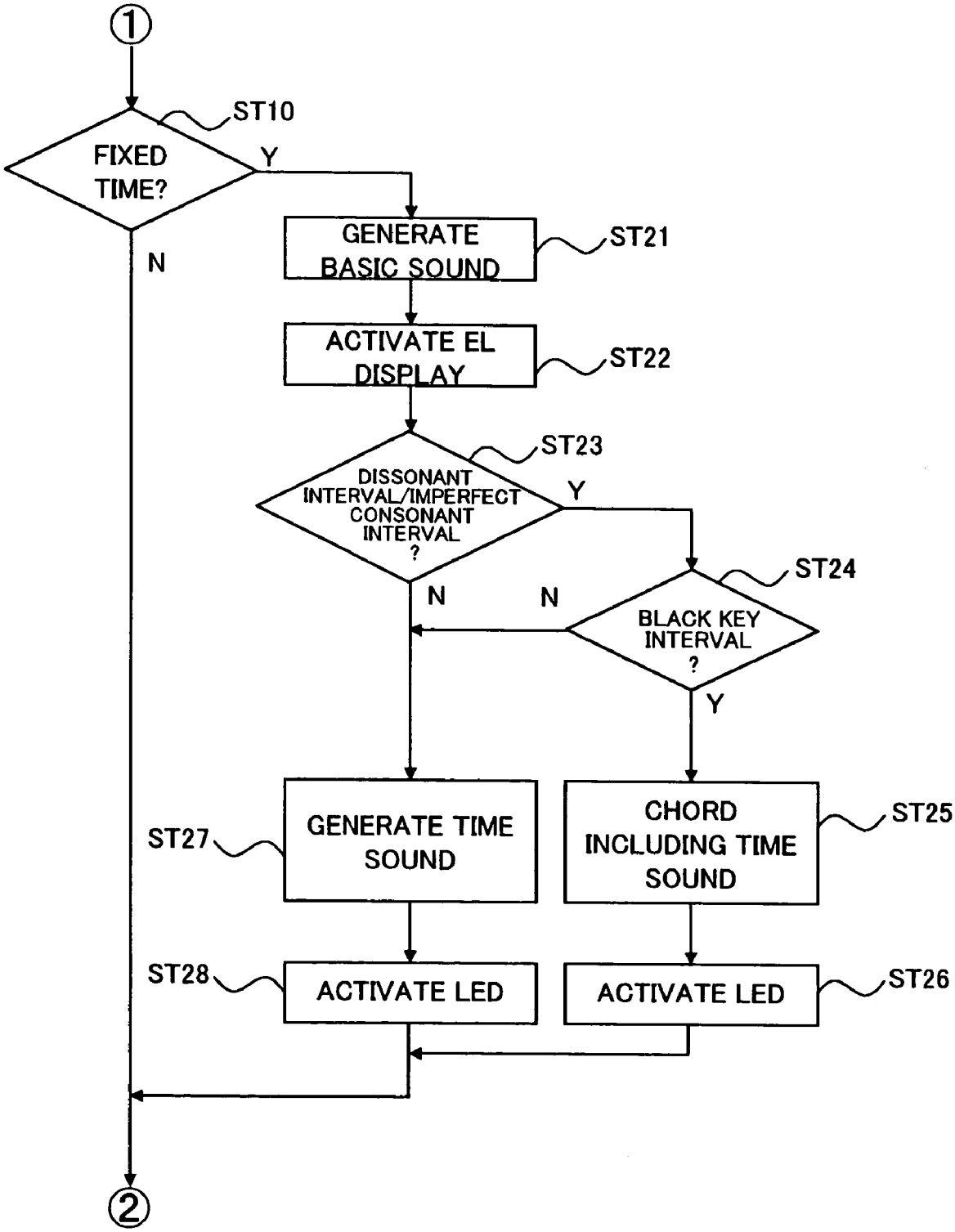
FIG. 14 is a flow chart for explaining the operation of the sound-scale generation device shown in FIG. 10.

FIG. 14 is a flow chart for explaining the operation of the sound-scale generation device shown in FIG. 10. The operation of the sound-scale generation device 1*d* of the above configuration will be explained focusing on the operation of the CPU 17 while referring to FIGS. 8 and 14. Here, as shown in FIG. 8, explanations of the steps the same as in the operation of the sound-scale generation device 1 will be omitted.

At step ST10, the CPU 17 judges if the time is a fixed time. Specifically, the CPU 17 judges if the time of a predetermined announcement time based on the time information counted by the clock 11 and the data "d" stored in the memory 14. When judging that the time is a fixed time, the CPU 17 causes the sound generator 15 to generate the basic sound "bs" (ST21) and causes the EL display 123 to emit light (ST22).

At step ST23, the CPU 17 judges if the time announcement sound "ts" to be made to be generated at that time is a time announcement sound "ts" of a dissonant interval and/or imperfect consonant interval with respect to the basic sound "bs". Specifically, the CPU 17, for example as shown in FIGS. 4C and 4D, judges if the time announcement sound "ts" to be made to be generated at that time is a time announcement sound "ts" of a dissonant interval and/or imperfect consonant interval with respect to the basic sound "bs" based on the data "d" stored in the memory 14.

When judging that the time announcement sound "ts" is a time announcement sound "ts" of a dissonant interval and/or imperfect consonant interval with respect to the basic sound "bs", the CPU 17 judges if the time announcement sound "ts" is a black key interval (ST24).

When judging in the judgment at step ST24 that the time announcement sound "ts" is a black key interval, it adds at least one component able to form a harmonic-sound including the time announcement sound "ts", for example, the major 3 harmonic-sound, to the time announcement sound "ts" to make the sound generator 15 generate the sound (ST25), makes the LEDs 12201 to 12211 of the LED display 122 corresponding to the time announcement sound "ts" and the announcement time display an image (ST26), and returns to the processing of step ST1.

On the other hand, when judging in the judgment at step ST23 that the time announcement sound "ts" to be made to be generated at that time is not a time announcement sound "ts" of a dissonant interval and/or imperfect consonant interval with respect to the basic sound "bs" and when judging at step ST24 that the time announcement sound "ts" is not a black key interval, it makes the sound generator 15 generate the time announcement sound "ts" as a pure tone (ST27), makes the LEDs 12201 to 12211 of the LED display 122 provide a display corresponding to the time announcement sound "ts" and the announcement time (ST28), and returns to the processing of step ST1.

As explained above, when a basic sound "bs" is generated from the sound generator 15, the EL display 123 emits light to show the center position o and the LEDs 12201 to 12212 of the LED display 122 corresponding to the time announcement sound "ts" are lit up, so it is possible to visually recognize the time announcement sound "ts". Further, since an EL display 123 is provided near the center position o, it is possible to obtain an easy grasp of the position of the LEDs 12201 to 12212 with respect to the faceplate 120 compared with the case of emission of light by the LEDs 12201 to 12212 alone.

Sixth Embodiment

Figure 15:
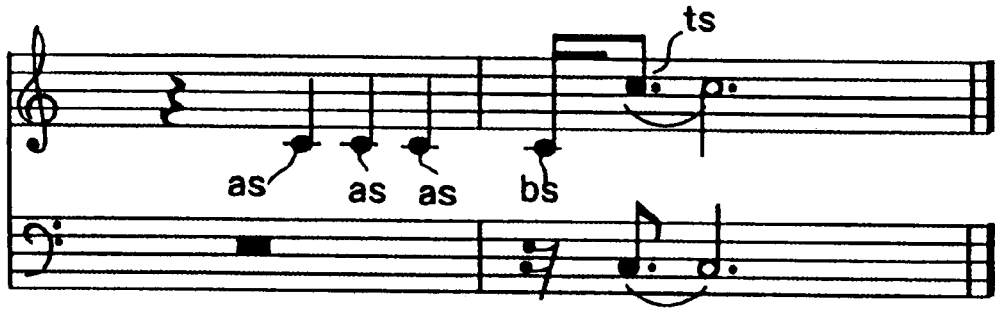
FIG. 15 is a view for explaining generation of sounds by a sound generator of a sound-scale generation device of a sixth embodiment of the present invention.

FIG. 15 is a view for explaining the generation of a sound by the sound generator of the sound-scale generation device of a sixth embodiment according to the present invention. The sound-scale generation device 1*e* according to this embodiment is configured substantially the same as the sound-scale generation device 1*a* according to the second embodiment, so only points of difference will be explained.

The CPU 17 causes the sound generator 15 to generate an announcement sound "as" before causing the sound generator 15 go generate the basic sound "bs". The announcement sound "as" is one of the sounds of the 12-sounds scale and for example is the same sound as the basic sound "bs". For example, as shown in FIG. 15, the CPU 17 successively causes the sound generator 15 to generate the announcement sound "as" three times, then causes it to generate the basic sound "bs" and the time announcement sound "ts" at a predetermined time.

As explained above, the sound-scale generation device 1*e* causes generation of an announcement sound "as" so as to enable the attention of the user to be drawn before causing the generation of the basic sound "bs" and time announcement sound "ts" and to facilitate recognition of the time announcement sound "ts" by the user.

Seventh Embodiment

Figure 16:
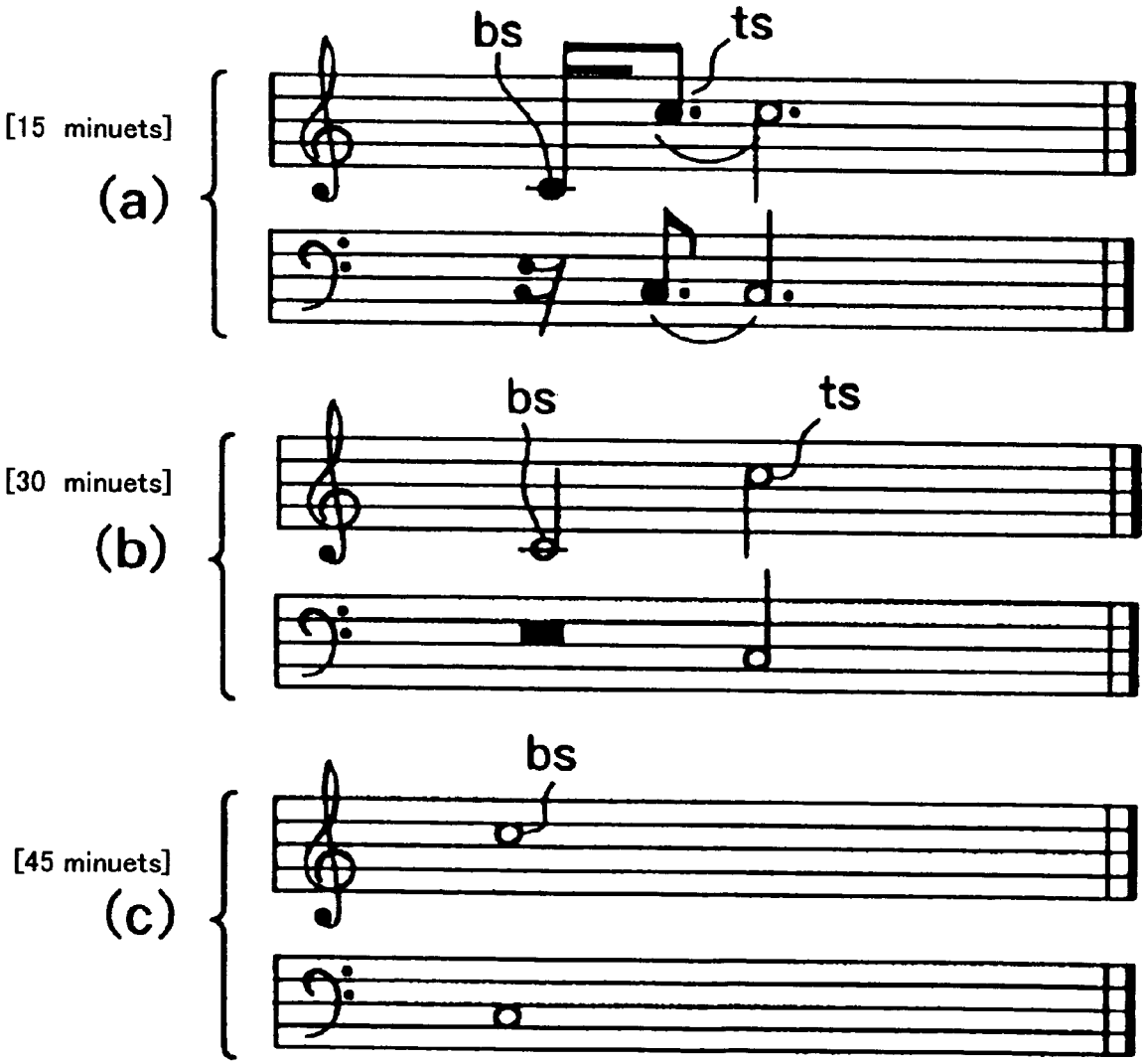
FIG. 16 is a view for explaining generation of sounds by a sound generator of a seventh embodiment of the sound-scale generation device of the present invention.

FIGS. 16A to 16C are views for explaining the generation of sounds by the sound generator of a seventh embodiment of the sound-scale generation device according to the present invention. The sound-scale generation device If according to the present embodiment is configured substantially the same as the sound-scale generation device 1*a* according to the second embodiment, so only the points of difference will be explained.

The CPU 17 causes the sound generator 15 to generate predetermined sounds at predetermined times in addition to the hour and the half hour. The CPU 17 for example causes the sound generator 15 to generate the basic sound "bs" and the time announcement sound "ts" at the first quarter hour as shown in FIG. 16A, causes the sound generator 15 to generate the basic sound "bs" and the time announcement sound "ts" on the half hour as shown in FIG. 16B, and causes the sound generator 15 to generate the basic sound "bs" and the time announcement sound "ts" on the third quarter hour as shown in FIG. 16C.

In this way, the sound-scale generation device 1*f* generates sounds at predetermined times other than the hour and the half hour, for example, at the first quarter hour and third quarter hour, whereby the user can recognize the time in detail.

Eighth Embodiment

The sound-scale generation device 1*g* according to the present embodiment is configured substantially the same as the sound-scale generation device 1*a* according to the second embodiment, so only points of difference will be explained. The CPU 17 controls the sound generator 15 so that the mode of generation of the scale-forming-sounds differs between even number times and odd number times among the times linked with the sounds of the 12-sounds scale. More specifically, for example, the sound generating controller 17 of the CPU 17 causes the sound generator 15 to generate the basic sound "bs" at an even number time, then causes the sound generator 15 to generate scale-forming-sounds corresponding to that time, causes the sound generator 15 to generate the basic sound "bs" at an odd number time, then causes the sound generator 15 to generate scale-forming-sounds corresponding to that time and further causes the sound generator 15 to generate a scale-forming-sound of one of the 12 scale-forming-sounds.

Further, the CPU 17 controls the sound generator 15 to generate a basic sound, then generate a scale-forming-sound corresponding to the time by a different tempo between even number times and odd number times in the times linked with the components of the 12-sounds scale. Specifically, for example, the CPU 17 makes the sound generator 15 generate a basic sound "bs" and time announcement sound "ts" by a similar tempo as the sound-scale generation device 1 according to the first embodiment at an even number time and makes the sound generator 15 generate a basic sound "bs" and time announcement sound "ts" by a tempo faster than the even number time at an odd number time.

The operation of the scale generating clock 1*g* of the above configuration will be explained simply next. When an even number time arrives, the CPU 17 makes the sound generator 15 generate a basic sound "bs", then makes the sound generator 15 generate a scale-forming-sound corresponding to that time by a tempo similar to the sound-scale generation device 1 according to the first embodiment.

When an odd number time arrives, the CPU 17 makes the sound generator 15 generate a basic sound "bs", then makes the sound generator 15 generate a scale-forming-sound corresponding to that time and further makes the sound generator 15 generate a scale-forming-sound of one of the 12 scale-forming-sounds.

As explained above, the number of the sounds generated from the sound generator 15 differs depending on whether the time is an even number time or odd number time, so a user can easily differentiate between an even number time and an odd number time. Further, since the tempo of sound generation from the sound generator 15 differs according to whether the time is an even number time or odd number time, it is possible to easily differentiate between an even number time and an odd number time.

Note that the invention is not limited to the above embodiments and can be suitably modified in various ways. In the embodiments, the sound synthesizing circuit of the sound generator was made a PCM sound source, but is not limited to this. For example, it may also be a frequency modulation synthesizer (FM) sound source, a musical instrument digital interface (MIDI) sound source compatible with the MIDI standard, or another sound source.

Further, in the fourth embodiment, harmonic-sounds including the basic sound "bs" and the time announcement sound "ts" were made to be generated at the sound generator 15, but the invention is not limited to this. For example, it is also possible to cause the sound generator 15 to generate a harmonic-sound including the time announcement sound "ts" and successively cause the sound generator 15 to generate the components of that harmonic-sound. By simultaneously causing the LED display 122 to emit light, the user can learn harmonic-sounds visually and acoustically.

In the fifth embodiment, the LED display 122 and the EL display 123 were provided, but the shapes and light emitting modes are not limited to these. For example, it is also possible to use light emitting elements other than LEDs and ELs. Further, the display may also be a liquid crystal display or other display.

In the eighth embodiment, two sounds were generated from the sound generator 15 at an even number time and three sounds at an odd number time, but the number of sounds generated are not limited to this. It is also possible to generate three sounds at an even number time and two sounds at an odd number time. Further, the tempo of generation of sounds at the odd number times was faster than the tempo of generation of sounds at the even number times, but the invention is not limited to this. Conversely, it is also possible to make the tempo of generation of sounds at the even number times faster than the tempo of generation of sounds at the odd number times.

Further, in these embodiments, the scale-forming-sounds in the 12-sounds scale were linked successively from low to high on the hour, but the invention is not limited to this. For example, it is also possible to conversely link them from high to low.

Further, it is also possible to make the sound generator 15 generate a sound by a glissando generating a sound from the basic sound "bs" to the time announcement sound "ts" continuously. By doing this, a sound from the basic sound "bs" to the time announcement sound "ts" is continuously generated, so it is possible to easily discriminate the time announcement sound "ts".

Further, the faceplate 120 displayed names of sounds showing sounds other than the numerals of the time display, but the names of the sounds are not limited to the above. For example, it is also possible to use the formats of other countries such as the names of sounds of the U.S., the U.K., Japan, Italy, and France.

The communicator 13 received the standard time information wirelessly from the standard time information providing station 2, but the invention is not limited to this. For example, it is also possible to access a network time protocol (NTP) server etc. providing standard time information through a not shown communication network to acquire that standard time information. By doing this, in an environment able to access an NTP server, the CPU 17 can modify the time information of the clock 11 based on the standard time information received by the communicator 13.

Summarizing the effects of the invention, it is possible to provide a sound-scale generation device and time-announcing clock eliminating the unpleasantness when a dissonant interval or an imperfect consonant interval is generated.

While the invention has been described with reference to specific embodiments chosen for purpose of illustration, it should be apparent that numerous modifications could be made thereto by those skilled in the art without departing from the basic concept and scope of the invention.

What is claimed is:

1. A sound-scale generation device comprising:

a clock means counting a time and generating a sound generation instruction signal at a fixed time, a sound generator able to generate a sound of a 12-sounds scale, a sound generating controller linking a sound of each sound-scale of the 12-sounds scale and a time corresponding to the fixed time and controlling the sound generator so as to generate a basic sound defined as one sound of the 12-sounds scale, and generate a first scale-forming-sound corresponding to the time at which the sound generating controller receives the sound generation instruction signal, and a harmonic-sound forming sound adder controlling the sound generator so as to generate a sound by superposing at least one of the harmonic-sound forming sounds able to form a harmonic-sound including the first scale-forming-sound when the sound generating controller makes the sound generator generate a second scale-forming-sound of a dissonant interval and/or imperfect consonant interval with respect to the basic sound.

2. A sound-scale generation device as set forth in claim 1, wherein the harmonic-sound forming sound adder controls the sound generator so as to generate a sound by superposing at least one of the harmonic-sound forming sounds able to form a harmonic-sound including the first scale-forming-sound when the sound generating controller makes the sound generator generate a third scale-forming-sound corresponding to a black key interval with respect to the basic sound.

3. A sound-scale generation device as set forth in claim 1, wherein the harmonic-sound forming sound adder controls the sound generator so as to generate a sound by superposing at least one of the harmonic-sound forming sounds able to form the harmonic-sound including the basic sound when the sound generating controller makes the sound generator generate the basic sound.

4. A sound-scale generation device as set forth in claim 1, wherein the sound generating controller controls the sound generator so as to generate an announcement sound for announcing the basic sound before making the sound generator generate the basic sound.

5. A sound-scale generation device as set forth in claim 1, further comprising:

a center position light emitting means provided at a substantially center position of a faceplate displaying the scale-forming-sound corresponding to the fixed times and emitting light at the fixed time and time light emitting means provided at positions corresponding to the scale-forming-sounds corresponding to the fixed times so as to surround the center position light emitting means and emitting light corresponding to the scale-forming-sounds.

6. A sound-scale generation device as set forth in claim 1, wherein the sound generating controller controls the sound generator so that the type of generation of the first scale-forming-sounds differ between even times and odd times among times linked with the sounds of the 12-sounds scale.

7. A sound-scale generation device as set forth in claim 1, wherein the sound generating controller controls the sound generator so as to generate the basic sound, then generate a fourth scale-forming-sound corresponding to that time by a tempo different between even times and odd times among times linked with the sounds of the 12-sounds scale.

* * * * *